US007454158B2

(12) United States Patent
Nakano et al.

(10) Patent No.: US 7,454,158 B2
(45) Date of Patent: Nov. 18, 2008

(54) IMAGE FORMING APPARATUS WITH ACCOMMODATION SPACES

(75) Inventors: Hiroshi Nakano, Nagoya (JP); Hiroshi Igarashi, Nagoya (JP); Atsushi Kato, Ichinomiya (JP)

(73) Assignee: Brother Kogyo Kabushiki Kaisha (JP)

( * ) Notice: Subject to any disclaimer, the term of this patent is extended or adjusted under 35 U.S.C. 154(b) by 131 days.

(21) Appl. No.: 11/506,187

(22) Filed: Aug. 18, 2006

(65) Prior Publication Data

US 2007/0048005 A1 Mar. 1, 2007

(30) Foreign Application Priority Data

Aug. 25, 2005 (JP) ..... 2005-244500
Aug. 25, 2005 (JP) ..... 2005-244501
Sep. 2, 2005 (JP) ..... 2005-254630

(51) Int. Cl.
*G03G 15/08* (2006.01)
*G03G 15/00* (2006.01)

(52) U.S. Cl. ..... 399/121; 399/110

(58) Field of Classification Search ..... 399/107, 399/110, 121, 116
See application file for complete search history.

(56) References Cited

U.S. PATENT DOCUMENTS 5,054,769 A 10/1991 Watashi
5,243,384 A 9/1993 Everdyke et al.
6,185,394 B1 * 2/2001 Lee ..... 399/116
6,328,155 B1 12/2001 Omura et al.
6,445,895 B2 9/2002 Shirasawa et al.
6,522,848 B2 * 2/2003 Wakana ..... 399/121
6,999,709 B2 * 2/2006 Park ..... 399/121
7,031,638 B2 * 4/2006 Tanizaki et al. ..... 399/121 X
7,054,578 B2 * 5/2006 Jung et al. ..... 399/110
2004/0136747 A1 7/2004 Tanizaki et al.

FOREIGN PATENT DOCUMENTS

| | | |
|---|---|---|
| JP | 2186365 | 7/1990 |
| JP | 5072867 | 3/1993 |
| JP | 5094058 | 4/1993 |
| JP | 7168474 | 7/1995 |
| JP | 10-319731 | 4/1998 |
| JP | 10198118 | 7/1998 |
| JP | 2000172086 | 6/2000 |

(Continued)

OTHER PUBLICATIONS

Office Action in Chinese Application No.: 2006101261451.

*Primary Examiner*—Sandra L Brase
(74) *Attorney, Agent, or Firm*—Banner & Witcoff, Ltd.

(57) ABSTRACT

A laser printer is detachably provided with a carrier belt, support rollers for supporting the carrier belt, and a belt unit provided with a belt frame. A unit support portion for supporting a bearing portion of the support roller and a unit support portion for supporting a bearing portion of the support roller are provided at a side of the main body of the apparatus. Urging by a coil spring allows the bearing portion to press the unit support portion against the support roller. An image forming unit that contains four process cartridges is detachably provided above the belt unit opposite to the belt. The belt unit may be removed from the main body by detaching the image forming unit.

27 Claims, 24 Drawing Sheets

FOREIGN PATENT DOCUMENTS

| | | |
|---|---|---|
| JP | 2000214728 | 8/2000 |
| JP | 2000275987 | 10/2000 |
| JP | 200120924 | 8/2001 |
| JP | 2001209294 A | 8/2001 |
| JP | 2002060039 | 2/2002 |
| JP | 2002108172 | 4/2002 |
| JP | 2002131997 | 5/2002 |
| JP | 2004109235 | 4/2004 |
| JP | 2004302375 | 10/2004 |

* cited by examiner

IMAGE FORMING APPARATUS WITH ACCOMMODATION SPACES

CROSS REFERENCE TO RELATED APPLICATION

This application claims priority from Japanese Patent Application No. 2005-244500 filed Aug. 25, 2005, 2005-244501 filed Aug. 25, 2005 and 2005-254630 filed Sep. 2, 2005. The entire content of these priority applications is incorporated herein by reference.

TECHNICAL FIELD

The disclosure relates to an image forming apparatus.

BACKGROUND

In the industrial field of the image forming apparatus, the structure detachably provided with a belt unit such as a carrier belt and an intermediate transfer belt has been supplied. Prior image forming apparatuses included a structure provided with the belt unit so as to be detached from one side of the main body through the linear sliding motion performed by the slide mechanism. The detachment of the belt unit from one side allows the access to the belt unit therefrom. In the case where it is difficult to access the belt unit from the top, for example, a large component is provided above the belt unit, or the image forming apparatus is desired to be used while avoiding the access to the belt unit from the top, the aforementioned structure is advantageous.

If the unit as the above-structured belt unit is detachably provided to the main body by merely sliding such unit linearly with the slide mechanism, the unit is required to be sufficiently held so as not to be dislocated from the position where it is installed. The mechanism for retaining the unit or the slide mechanism may enlarge and complicate the structure.

SUMMARY

An image forming apparatus as one aspect of the invention includes a first accommodation space communicated with an opening formed in a side portion of a main body, and a second accommodation space communicated with the first accommodation space. The first accommodation space is formed to detachably accommodate a first unit so as to be detached therefrom and attached thereto through the opening. The second accommodation space detachably accommodates a second unit. The second unit is structured to pass at least a portion of the first accommodation space between the second accommodation space and the opening. The second unit, thus, can be detached and attached through the accommodation space of the first unit.

BRIEF DESCRIPTION OF THE DRAWINGS

Illustrative aspects in accordance with the invention will be described in detail with reference to the following figures wherein.

DETAILED DESCRIPTION

Figure 1:
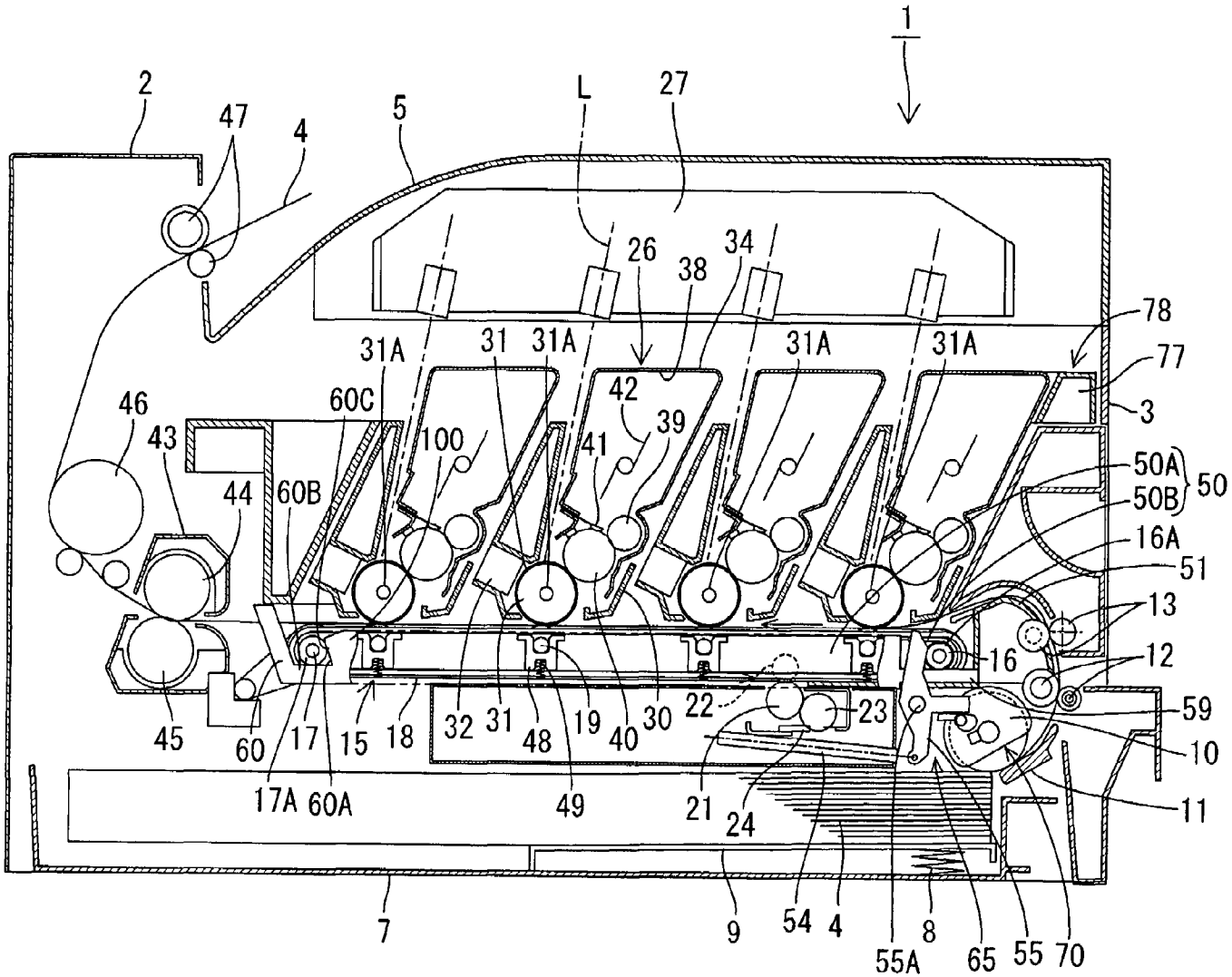
FIG. 1 is a sectional side elevation view schematically showing a structure of a laser printer at one side according to one aspect of the invention.
Figure 2:
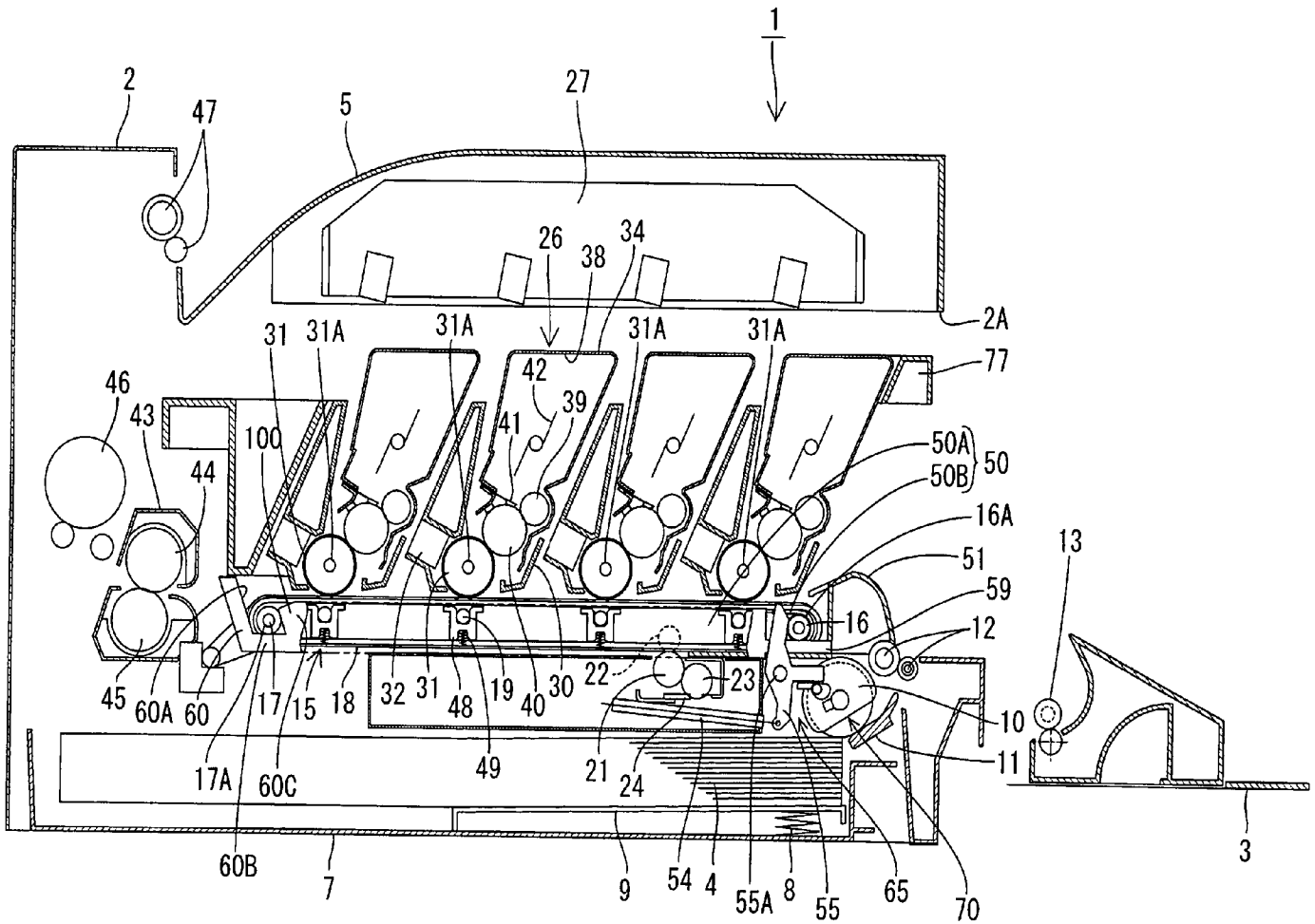
FIG. 2 is a sectional view of the laser printer at one side shown in FIG. 1 having a front cover opened.

A laser printer 1 which is a color laser printer of direct transfer tandem type includes a substantially box-like body casing 2 as shown in FIG. 1. A front cover 3 that can be opened and closed is attached to a front surface (right side of the drawing) of the body casing 2. Process cartridges 26 or a belt unit 15 within the body casing 2 may be replaced by opening the front cover 3 as shown in FIG. 2. An ejected paper tray 5 on which sheets of paper 4 that have been subjected to the image forming process are stacked is formed on the upper surface of the body casing 2.

A paper feed tray 7 on which the sheets of paper 4 subjected to the image forming process are stacked is set so as to be withdrawn forward. A platen 9 that is tiltably operated under the urging force of a spring 8 so as to lift up the front edge of the paper 4 is provided within the paper feed tray 7. A pick-up roller 10 and a separation pad 11 in pressure contact therewith under the urging force of a spring (not shown) are provided above the front end of the paper feed tray 7. A pair of paper feed rollers 12 are provided obliquely forward above the pick-up roller 10, and a pair of resist rollers 13 are further provided above the pair of paper feed rollers 12.

The upper most paper 4 among those stacked on the paper feed tray 7 is pressed toward the pick-up roller 10 by the platen 9. As the pick-up roller 10 rotates, the paper 4 is sandwiched between the pick-up roller 10 and the separation pad 11 so as to be separated and fed one by one. The paper 4 that has been fed from the sandwiched state between the pick-up roller 10 and the separation pad 11 is U-like turned by the paper feed rollers 12 rearward and further carried to the resist rollers 13. The paper 4 is fed by the resist rollers 13 to the belt unit 15 rearward thereof at a predetermined timing.

The belt unit 15 is structured to be detachable with respect to the body casing 2, and provided with a carrier belt 18 that horizontally extends between a pair of support rollers 16, 17, which are apart from each other in the front-rear direction. The rear first support roller 17 of the pair of support rollers 16 and 17 is a drive roller that is rotated to be driven by power of a motor (not shown), and the front second support roller 16 is a tension roller for applying a tensile force to the carrier belt 18. The carrier belt 18 is an endless belt formed of a resin material, for example, polycarbonate and the like. It is operated to circulate counterclockwise as shown in FIG. 1 when the support roller 17 as the drive roller is rotated to be driven such that the paper 4 placed on the carrier belt 18 is carried rearward. Photosensitive drums 31 and four transfer rollers 19 each oppositely provided in the respective process cartridges 26 are arranged at constant intervals in a longitudinal direction at the inside of the carrier belt 18. The carrier belt 18 is, thus, interposed between the respective photosensitive drums 31 and the corresponding transfer rollers 19. During the transfer process, the transfer bias voltage is applied between the transfer rollers 19 and the photosensitive drums 31, respectively. The structure of the belt unit 15 will be described later.

A cleaning roller 21 is provided below the belt unit 15 for removing toner or paper dust adhered to the carrier belt 18. The cleaning roller 21 is formed by applying a foaming material, for example, silicon around a metal shaft member, opposite to the metal back-up roller 22 provided on the belt unit 15 with respect to the carrier belt 18. A predetermined bias voltage is applied between the cleaning roller 21 and the back-up roller 22 such that the toner on the carrier belt 18 may be electrically introduced to the cleaning roller 21. The cleaning roller 21 abuts against a metal recovery roller 23 for removing the toner adhered onto the cleaning roller 21. The recovery roller 23 further abuts against a blade 24 that scratches to remove the toner adhered onto the recovery roller 23.

Four process cartridges 26 are arranged in the longitudinal direction above the belt unit 15 opposite thereto. The process cartridges 26 correspond to colors of Magenta, Yellow, Cyan and Black, respectively, and may be detached from the position opposite to the belt unit 15. A scanner portion 27 provided above those process cartridges 26 serves to irradiate a laser beam L corresponding to the respective colors onto a surface of the corresponding photosensitive drum 31 on the basis of the predetermined image data through rapid scanning.

The process cartridge 26 includes a cartridge frame 30, a photosensitive drum 31 and a scorotron type electrifier 32 provided below the cartridge frame 30, and a development cartridge 34 detachably set to the cartridge frame 30. As each of the process cartridges 26 has the same structure except the color of the toner to be stored, the second process cartridge from the left shown in FIG. 1 is only designated with a reference numeral, and reference numerals for the rest will be omitted.

The photosensitive drum 31 is formed by coating a positively charged photosensitive layer formed of a polycarbonate, for example around a surface layer of a metal drum body that has been grounded.

The scorotron type electrifier 32 is provided obliquely rearward above the photosensitive drum 31 such that they face with each other at a predetermined interval so as not to contact with each other. The scorotron electrifier 32 serves to positively electrify over a whole surface of the photosensitive drum 31 uniformly by causing the wire for charging, for example, tungsten, to generate a corona discharge.

The development cartridge 34 has a substantially box-like shape having a toner storage chamber 38 at the upper portion, and a supply roller 39, a development roller 40, and a layer thickness control blade 41 provided at the lower portion. Each of the toner storage chambers 38 stores nonmagnetic single component toner that has been positively charged as the development agent for such colors as Yellow, Magenta, Cyan, and Black, respectively. Each of the respective toner storage chambers 38 is provided with an agitator 42 that agitates the toner.

The supply roller 39 is formed by coating a metal roller shaft with a conductive foaming material. The development roller 40 is formed by coating a metal roller shaft with a conductive rubber material. The toner discharged from the toner storage chamber 38 is supplied to the development roller 40 accompanied with the rotation of the supply roller 39, and positively friction charged between the supply roller 39 and the development roller 40. The toner supplied onto the development roller 40 proceeds between the layer thickness control blade 41 and the development roller 40 accompanied with the rotation of the development roller 40 and is further friction charged sufficiently so as to be carried on the development roller 40 to form a thin layer with a uniform thickness.

The surface of the photosensitive drum 31 during rotation is uniformly charged positively by the scorotron electrifier 32. Thereafter it is exposed to rapid scanning of the laser beam from the scanner portion 27 such that the electrostatic latent image corresponding to the image to be formed on the paper 4 is generated.

Upon rotation of the development roller 40, the toner carried thereon that has been positively charged is brought into contact with the opposite photosensitive drum 31 such that the toner is supplied to the electrostatic latent image generated on the surface of the photosensitive drum 31. Accordingly the electrostatic latent image on the photosensitive drum 31 may be visualized, that is, the toner image developed by reversal development is carried on the surface of the photosensitive drum 31.

The toner image carried on the surface of the respective photosensitive drums 31 is sequentially transferred on the paper 4 under the negative transfer bias applied to the transfer rollers 19 while the paper 4 carried by the carrier belt 18 is fed through the respective transfer positions between the photosensitive drums 31 and the transfer rollers 19. The paper 4 on which the toner image has been transferred is fed to a fixation unit 43.

The fixation unit 43 is disposed to the rear of the belt unit 15 within the body casing 2, and provided with a heat roller 44 including a heat source, for example, a halogen lamp, which is driven to be rotated, and a press roller 45 oppositely positioned to press the heat roller 44 and driven through rotation. The fixation unit 43 heats the paper 4 that carries the four-colored toner image while being sandwiched and carried between the heat roller 44 and the press roller 45 so as to fix the toner image on the paper 4. The thermally fixed paper 4 is carried to discharge rollers 47 at the upper portion of the body casing 2 by a carrier roller 46 diagonally backward above the fixation unit 43. The paper 4 is then discharged onto the ejected paper tray 5 by the discharge rollers 47.

Figure 3:
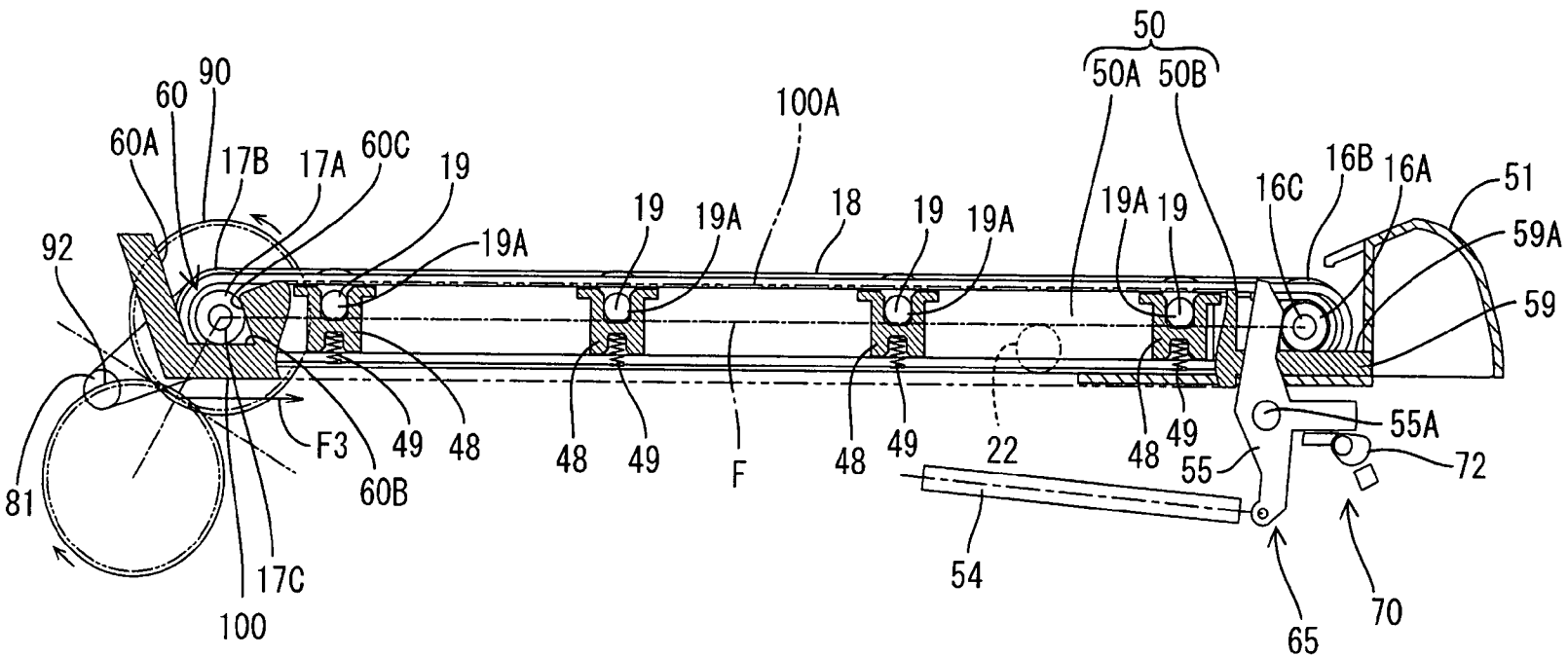
FIG. 3 is a partial sectional view of a belt unit and a peripheral portion.

FIG. 3 is a partial sectional view of the belt unit and the peripheral portion seen from the side. In the belt unit 15, the support roller 17 is rotatably supported at the rear end of the belt frame 50 having opposing left and right side walls (only the left side wall is shown in FIG. 1 representing the laser printer 1 seen from the front side) via a bearing portion 17A that supports a roller shaft 17C. The support roller 16 is rotatably supported at the front end of the belt frame 50 via a bearing portion 16A that supports a roller shaft 16C. The bearing portion 17A is associated with the roller portion 17B of the support roller 17 in the direction that intersects the rotary shaft of the support roller 17. The relative movement of the bearing portion 17A away from the support roller 16 causes the roller portion 17B of the support roller 17 to be moved away from the roller portion 16B of the support roller 16 such that the tensile force is applied to the carrier belt 18. The tensile force application mechanism will be described later. The bearing portion 17A functions as a reference protrusion for locating the belt unit 15.

More specifically, the belt frame 50 includes a frame body 50A that bears the support roller 17 at the rear end, and a slide bearing member 50B slidably provided in the longitudinal direction at the front end of the frame body 50A. The slide bearing member 50B bears the support roller 16 so as to be allowed to have the relative movement in the longitudinal direction with respect to the support roller 17 at the rear end. The carrier belt 18 extends between the pair of the support rollers 16 and 17.

Each of the left and right side walls of the belt frame 50 is provided with four transfer rollers arranged in the longitudinal direction at a uniform interval as described above. Each end portion of the roller shaft 19A of the respective transfer rollers 19 is inserted through the through hole with long diameter in the vertical direction formed in the left and right side walls so as to protrude outward and be rotatably supported. A transfer roller bearing member 48 provided in the body casing 2 bears each protruding end portion of the roller shaft 19A upon installation therein. The respective transfer roller bearing members 48 are urged upward by springs 49, respectively such that the respective transfer rollers 19 push the carrier belt 18 against the corresponding photosensitive drums.

The belt unit 15 rotatably supports the back-up roller 22 pressed by the cleaning roller 21 having the carrier belt 18 interposed in the state where the belt unit 15 is installed in the body casing 2 (see FIGS. 1 and 2). A guide member 51 that forms the carrier path that guides the paper to make a U-like turn from the paper feed tray 7 is integrally provided at the front end of the belt frame 50. The entire body of the belt unit 15 may be detached from the body casing 2 by withdrawing the guide member 51 with the hand as described later.

As shown in FIGS. 1 and 2, a tensile force application mechanism 65 including a coil spring 54 is provided at the front end of the belt unit 15 in the body casing 2. The tensile force application mechanism 65 includes a pair of levers 55 and 55 (second abutment portions), each center of which is rotatably supported at the rotary shaft 55A in the lateral direction, and a pair of coil springs 54 and 54 that urge the respective levers 55 and 55. Referring to FIG. 1, only the left side of the mechanism is shown when the laser printer 1 is seen from the front side.

Each of the coil springs 54 has its rear end fixed to the side of the body casing 2, and its front end as a free end connected to the lower end portion of the lever 55. The lever 55 has a top end swingable against the elastic force of the coil spring 54. Two pairs of the levers 55 and the coil springs 54 are arranged to interpose the front end of the accommodated belt frame 50 therebetween. Although two pairs of levers 55 and coil springs 54 are disclosed, the quantity may change as need be and not depart from the scope of the present invention.

The portion for accommodating the belt unit 15 within the body casing 2 is provided with unit support portions 59 and 60 for locating the belt unit 15. The unit support portion 59 support a pair of left and right bearing portions 16A each supporting the left and right end portions of the roller shaft of the support roller 16 projecting from the belt frame 50 of the belt unit 15. The unit support portion 59 corresponds to the "second wall portion" of the invention. In the disclosure, the second locate member is formed of the unit support portion 59 and the levers 55.

The unit support portion 60 corresponds to the first locate member which has a guide groove 60A (see FIG. 1) through which the pair of bearing portions 17A and 17B for supporting the left and right ends of the roller shaft 17C of the support roller 17 that projects from the belt frame 50 are inserted. The bearing portion 17A for the support roller 17 is positioned on the bottom surface 60B of the guide groove 60A of the unit support portion 60. The bottom surface 60B corresponds to the "first wall portion" in the invention. The front surface 60C of the guide groove 60A of the unit support portion 60 abuts against a surface of the bearing portion 17A opposite to the support roller 16. The front surface 60C corresponds to the first abutment portion in the invention. The further description of the structure of the unit support portion 60 will be described later.

Referring to FIGS. 1 and 3, the bearing portion 17A of the belt unit 15 is inserted through the guide groove 60A of the unit support portion 60, and the bearing portion 16A is positioned on the unit support portion 59. The lever 55 abuts against the rear surface of the bearing portion 16A to elastically deform the coil spring 54 to be extended. The restoring force of the coil spring 54 urges the support roller 16 in the direction away from the support roller 17 (forward) such that the tensile force is applied to the carrier belt 18.

The structure of the present invention is provided with the support rollers 17 and 16 for supporting the carrier belt 18. The unit support portion 60 including the bottom surface 60B that supports the bearing portion 17A from one side, and the front surface 60C positioned at the side different from that of the bottom surface 60B is provided at the side of the support roller 17. The unit support portion 59 that rotatably supports the support roller 16, and the levers 55 are provided at the side of the support roller 16, which are urged by the coil spring 54 as the urging member in the direction in which the bearing portion 17A and the support roller 16 move away from each other.

The coil spring 54 urges the bearing portion 17A to press the unit support portion 60 to the side of the support roller 16. Meanwhile, the unit support portion 60 is structured to have the angle formed by a wall surface of the bottom surface 60B and a wall surface of the front surface 60C smaller than 90° (for example, 70°). The bearing portion 17A is interposed between the bottom surface 60B and the front surface 60C.

The guide groove 60A has a recess that inclines downward at the front, and the front surface 60C inclines with respect to the horizontal bottom surface 60B.

At the side of the support roller 16, the unit support portion 59 supports the support roller 16 from the lower side, and the lever 55 supports the support roller 16 from the side different from that of the unit support portion 59 (from the rear side). The angle formed by the wall surface of the lever 55, in relation to the wall surface 59A, is set to be smaller than 90°, for example, 80°. The top surface of the unit support portion 59 is substantially horizontal. The surface of the lever 55 that abuts against the bearing portion 16A inclines with respect to the top surface of the unit support portion 59 at the aforementioned angle. The distance between the leading ends of the front surface 60C of the unit support portion 60 and the lever 55 is longer than the distance between the bearing portions 16A and 17A. The belt unit 15 is located within the body casing 2 in the vertical and the longitudinal directions, and the tensile force is further applied to the carrier belt 18 by the restoring force of the coil spring 54.

The present invention is structured such that a virtual plane F (substantially horizontal in the disclosure) formed by connecting the rotary shafts of the support rollers 17 and 16 is in parallel with the wall surface of the bottom surface 60B. The front surface 60C has the wall surface inclined with respect to the virtual plane F. The wall surface 59A is substantially in parallel with the virtual plane F. In the disclosure, the wall surface of the bottom surface 60B has a horizontal plane in parallel with that of the wall surface 59A of the unit support portion 59. The coil spring 54 urges the roller shaft 16C of the support roller 16 along the wall surface 59A in the direction away from the support roller 17.

A first gear 90 is provided to the roller shaft 17C (corresponding to the shaft of the first support roller) of the support roller 17, and provided with a second gear 92 that transfers the drive force to the first gear 90. In accordance with the drive force transferred from the second gear 92 to the first gear 90, the force directed toward the support roller 16 is applied to the roller shaft 17C of the support roller 17. More specifically, the direction in which the force directed from the second gear 92 at the drive side to the first gear 90 at the driven side (direction of the line of action with respect to the tangential line of base circles of those gears) is inclined downward as shown in the arrow F3 of FIG. 3. The partial output directed to the support roller 16 is generated in the horizontal direction. The pressure angle is set with respect to the first and the second gears 90 and 92 so as to generate the aforementioned force.

Figure 4:
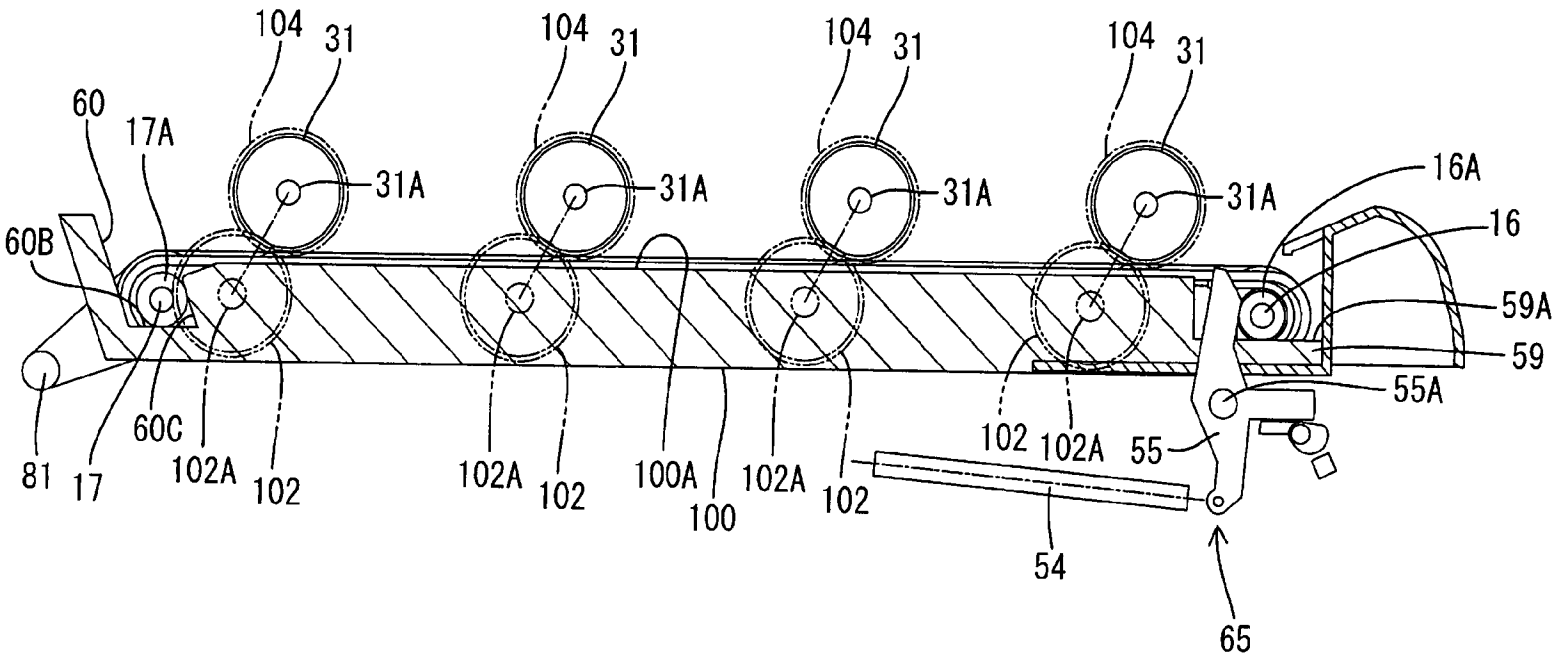
FIG. 4 is a partial sectional view that illustrates a mechanism that transfers a drive force to a photosensitive drum.

FIG. 4 is a view representing a mechanism for transferring the drive force to the photosensitive drum 31.

Referring to FIG. 4, the unit support portions 59 and 60 are integrally provided to form a part of a frame 100 of a main body. The frame 100 rotatably supports, on shafts 102A, four drive gears 102 each of which applies the drive force to the photosensitive drum 31. In other words, the member that locates the belt unit 15 also locates the drive gears 102 for the photosensitive drums 31.

A drive shaft 31A of the photosensitive drum 31 is provided with a driven gear 104 that receives the drive force applied by the drive gear 102. In FIG. 4, the first and the second gears 90 and 92 shown in FIG. 3 are omitted.

Figure 5:
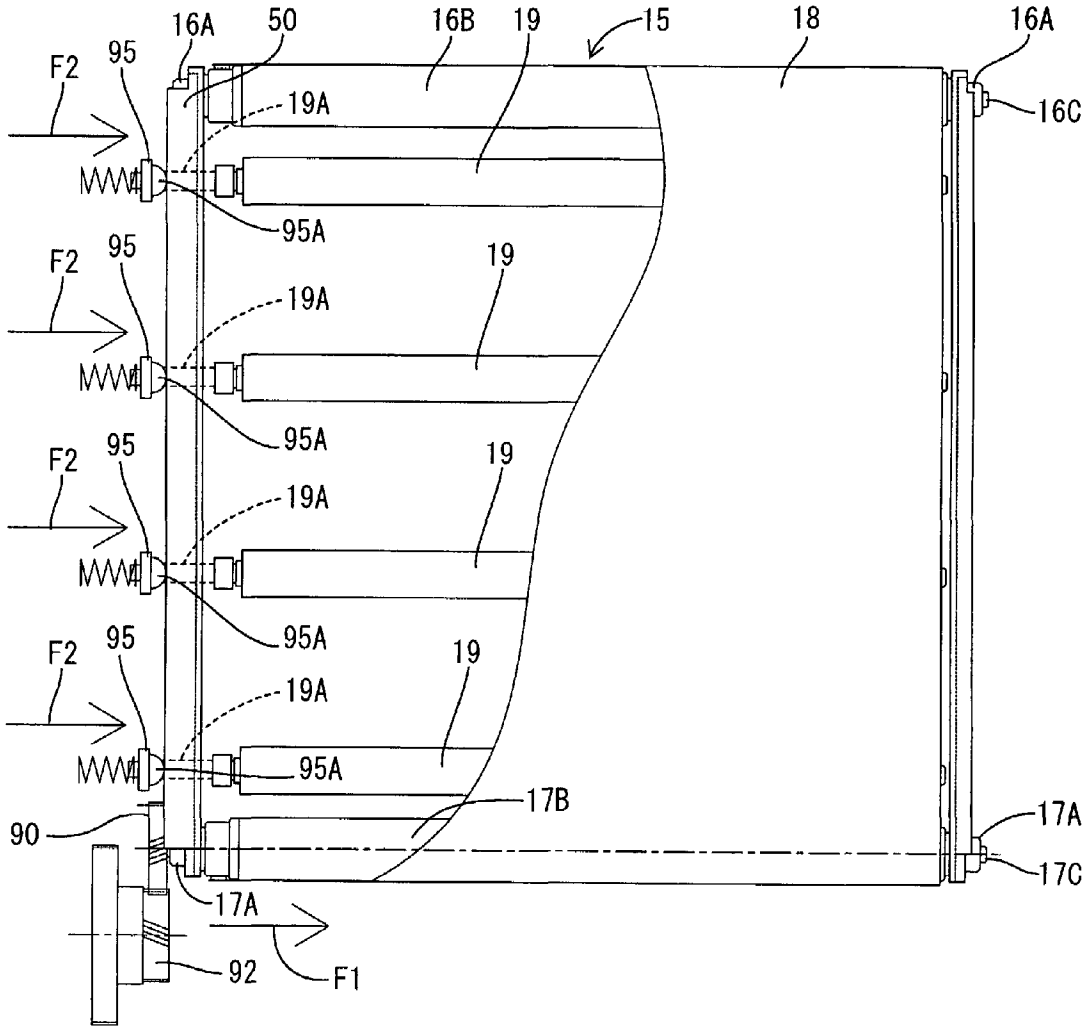
FIG. 5 is a partial sectional view that illustrates a mechanism that applies a thrust force to the belt unit.

FIG. 5 shows the belt unit 15 and its periphery seen from the top. In FIG. 5, the guide member and the shaft portion are omitted.

Referring to FIG. 5, the roller shaft 17C of the support roller 17 is provided with the first gear 90. The second gear 92 for transferring the drive force to the first gear 90 is provided at the side of the main body. In the structure of the disclosure, the first and the second gears 90 and 92 are formed as helical gears. In response to the drive of the second gear 92, the thrust force (in the direction of arrow F1) along the roller shaft 17C of the support roller 17 is applied to the first gear 90.

The belt unit 15 is provided with transfer rollers 19 to which power is supplied from outside of the belt unit 15 via roller shafts 19A (corresponding to the terminal portion). The main body in which the belt unit 15 is installed is provided with external terminal portions 95 that are electrically coupled with the roller shafts 19A while urging the roller shafts 19A in the same direction as that for applying the thrust force, and shown as the arrow F2. The transfer roller 19 receives the application of the transfer bias voltage while receiving the force from the external terminal portion 95. Specifically, the external terminal portion 95 has one end connected to a support portion (not shown), and has a terminal 95A at the other end in contact with the roller shaft 19A. The terminal 95A makes it possible to apply the voltage to the roller shaft 19A as well as the force.

In the structure of the disclosure, the thrust force toward one side is applied through urging of the external terminal portion 95 and gear transfer performed by the first and the second gears 90 and 92 such that the belt unit 15 is urged against the main body.

A release mechanism 70 that releases the tensile force applied state where the tensile force is applied by the tensile force application mechanism 65 (located state) will be described referring to FIGS. 6A and 6B.

Referring to the drawings, the lever 55 includes a projecting portion 55B that projects forward from the center. A pair of left and right cams 72 corresponding to the press members that are rotatably supported at the rotary shaft 71 are provided below the projecting portion 55B in the lateral direction, respectively (only the left cam is shown in the drawing). Each of the cams 72 has a large-diameter portion at one side. The pair of left and right cams 72 are integrally and rotatably provided with release levers 73, respectively. More specifically, the release lever 73 has substantially a U-like shape, and both end portions directly associated with the cam 72 or indirectly associated therewith via a gear mechanism and the like.

Figure 6A:
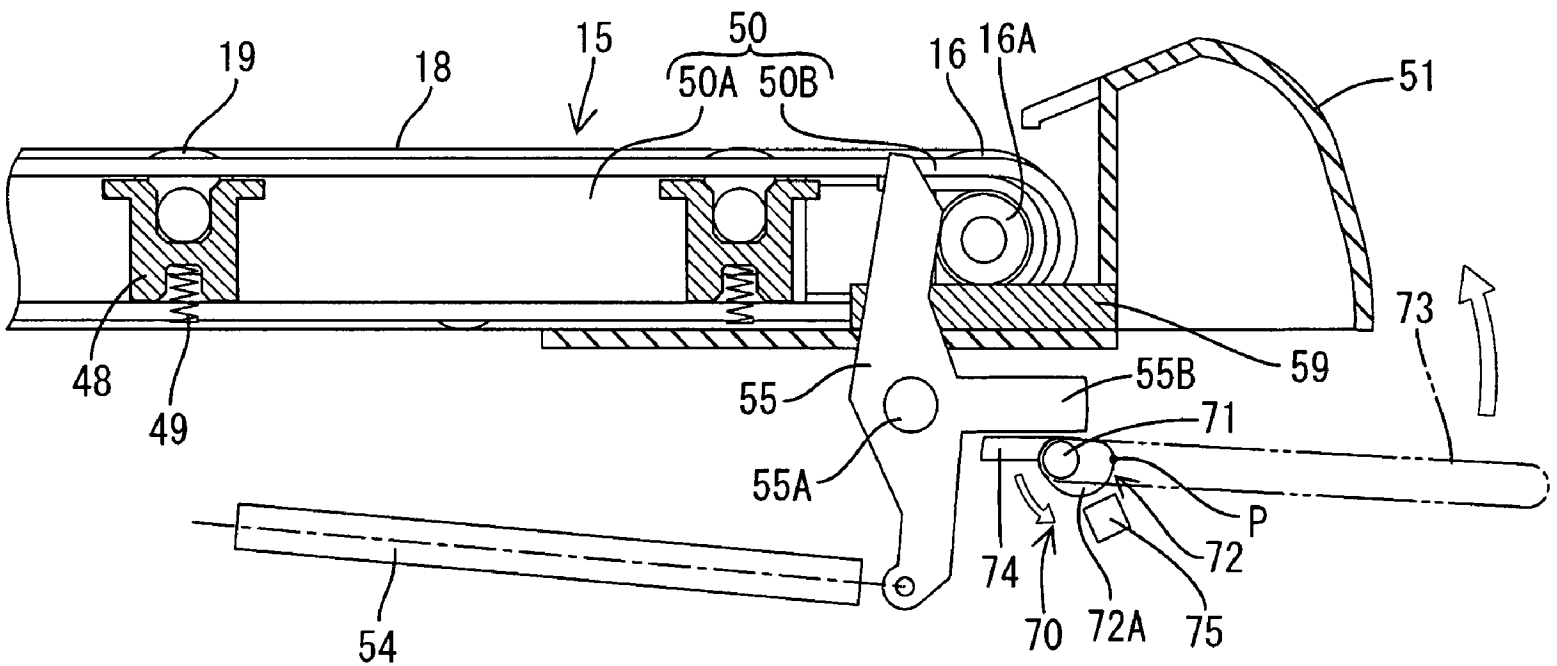
FIG. 6A is an enlarged sectional view that shows the front end portion, a tensile force application mechanism, and a release mechanism of the belt unit.
Figure 6B:
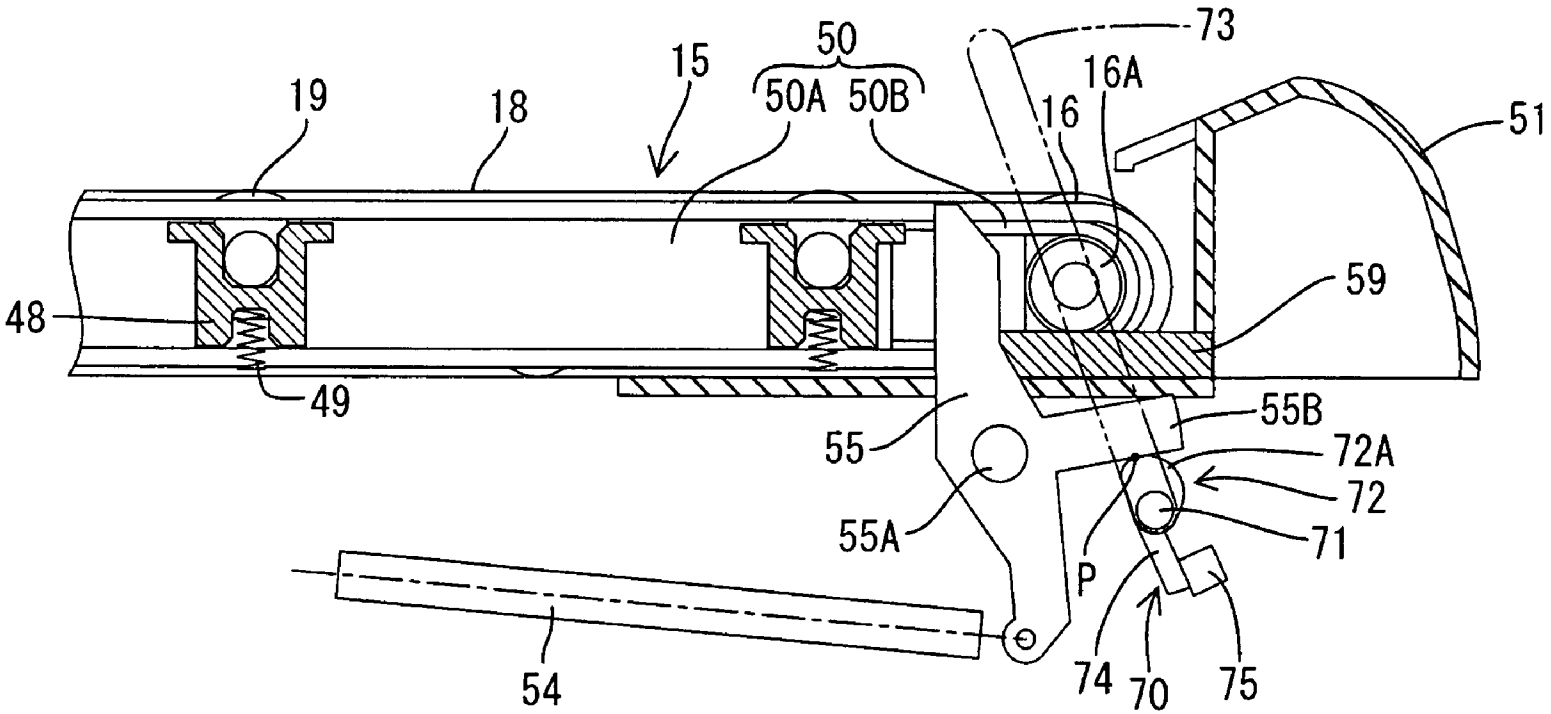
FIG. 6B is an enlarged sectional view that shows the front end portion, the tensile force application mechanism, and the release mechanism of the belt unit.

FIG. 6A shows the state where the lever 55 abuts against the bearing portion 16A to apply the tensile force to the carrier belt 18, that is, the tensile force applied state. In this state, the cam 72 has its large-diameter portion 72A directed forward. When the release lever 73 is turned counterclockwise from the aforementioned state, the large-diameter portion 72A of the cam 72 abuts against the projecting portion 55B of the lever 55 from the lower portion. The lever 55 is pressed to turn toward the direction away from the bearing portion 16A (counterclockwise) against the tensile force of the tensile coil spring 54.

When the release lever 73 is further turned, a stopper protrusion 74 integrally rotatable with the cam 72 abuts against a stopper 75 over the position at which the maximum diameter point P of the large-diameter portion 72A of the cam 72 contacts with the projecting portion 55B. This may restrict further turning of the release lever 73. The lever 55 moves away from the bearing portion 16A, and is held in the position at which the tensile force applied to the carrier belt 18 is released. The cam 72 and the stopper 75 function as a retention mechanism that retains the release mechanism in the released state.

Figure 7:
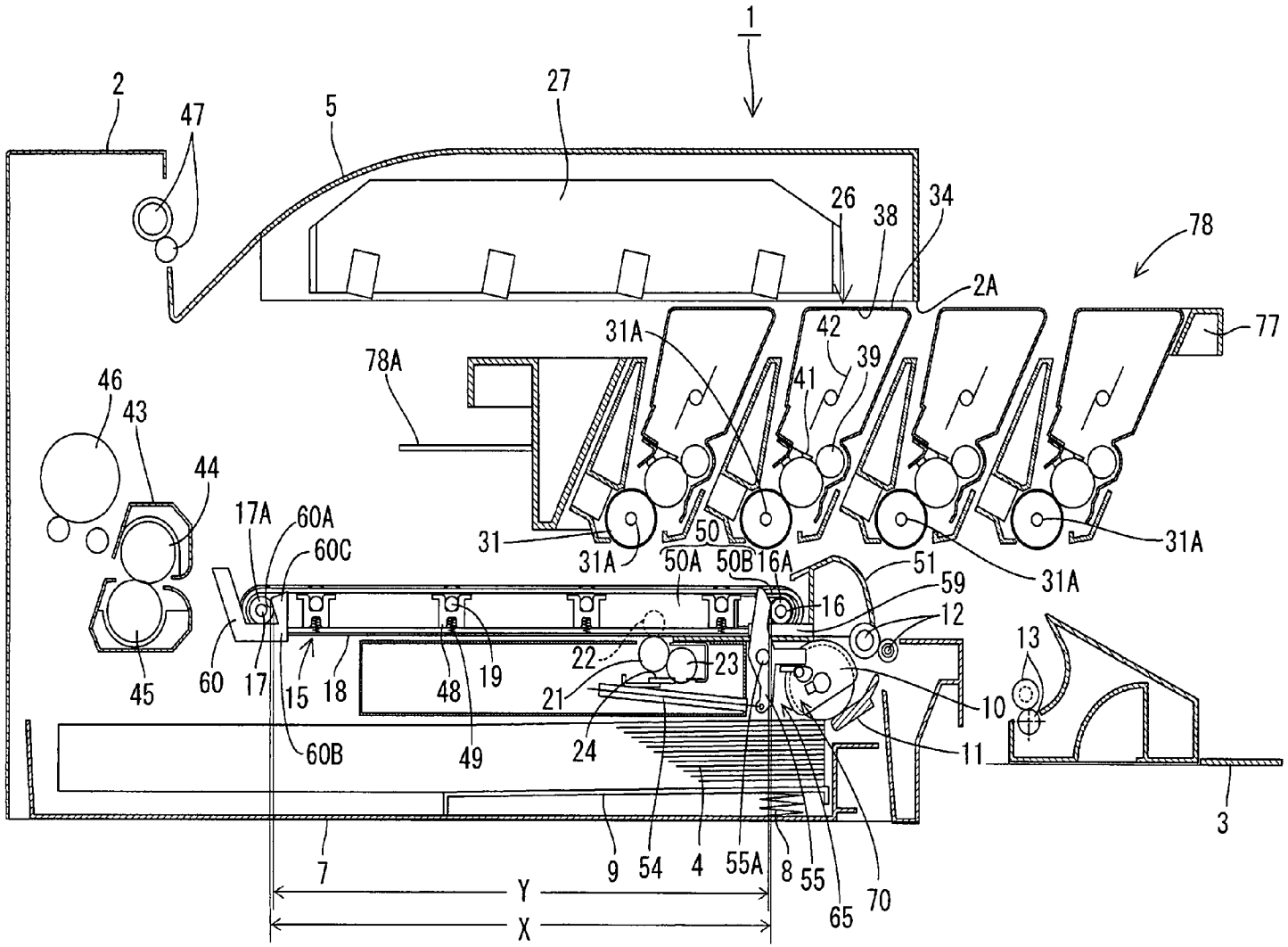
FIG. 7 is a sectional side elevation view of the structure at one side showing the state where the image forming unit is removed from the body casing.
Figure 8:
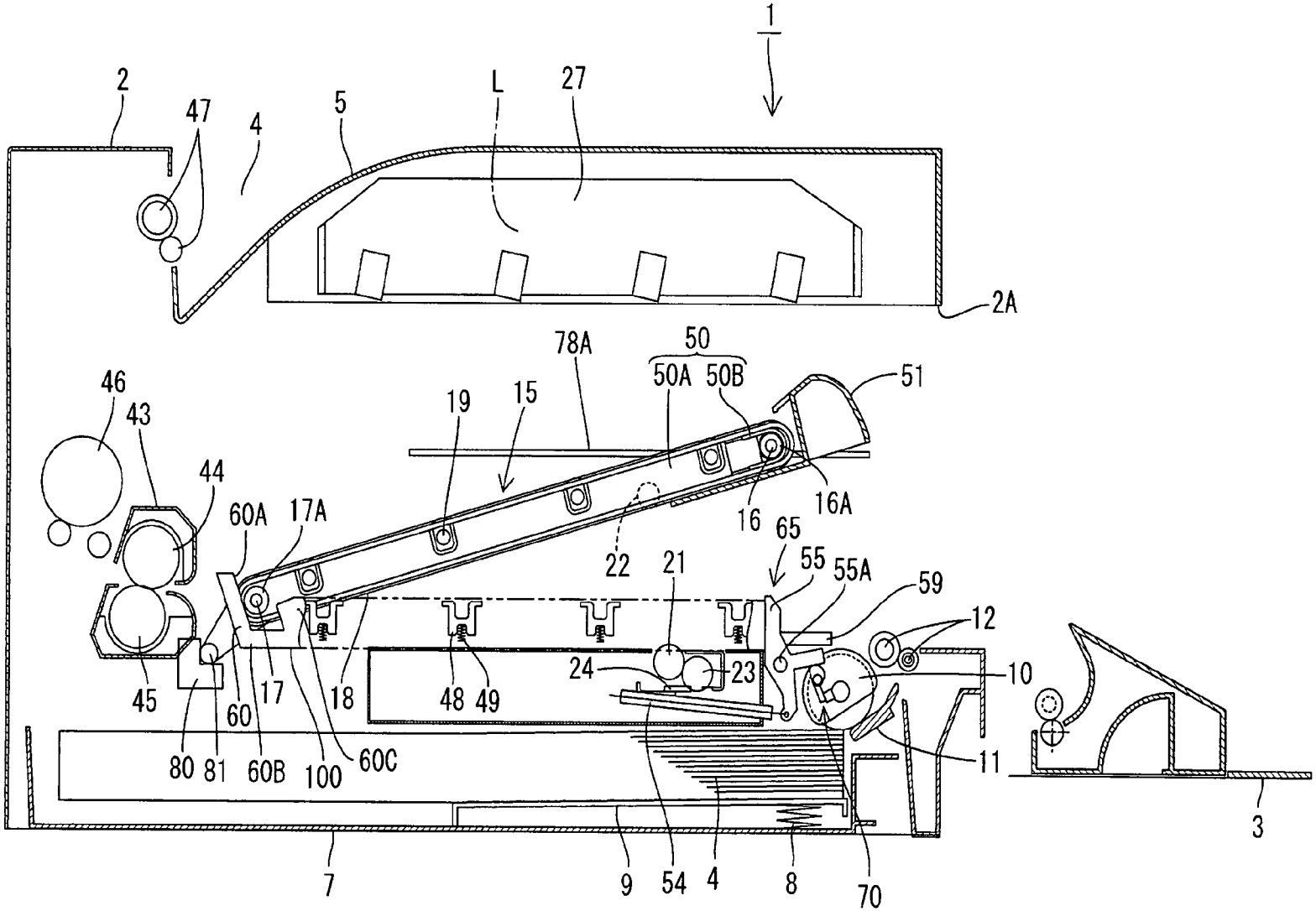
FIG. 8 is a sectional side elevation view of the structure at one side showing the state where the belt unit is detached from the body casing.

The structure of the disclosure is provided with a frame 77 having four process cartridges 26 within the body casing 2. Referring to FIG. 7, an image forming unit 78 (opposite to the belt unit) formed of the frame 77 and those four process cartridges 26 are slidably provided along a guide rail 78A, and may be removed from an opening 2A formed in the body casing 2. In order to remove the carrier belt 18, the front cover 3 is opened as shown in FIG. 2, and the image forming unit 78 is slidably withdrawn as shown in FIG. 7. The space above the belt unit 15 for accommodating the image forming unit 78 is widely opened to allow easy access to the belt unit 15 via the opening 2A.

Then the release lever 73 is turned into the released state (see FIG. 6B) when the lever 55 is apart from the bearing portion 16A from the located state (see FIG. 6A) where the lever 55 abuts against the bearing portion 16A. As the guide member 51 integrally formed with the belt unit 15 is disposed at the position closer to the opening 2A than the carrier belt 18, the guide member 51 is gripped to lift up the front end portion of the belt unit 15 toward the accommodating space of the image forming unit 78.

Figure 9A:
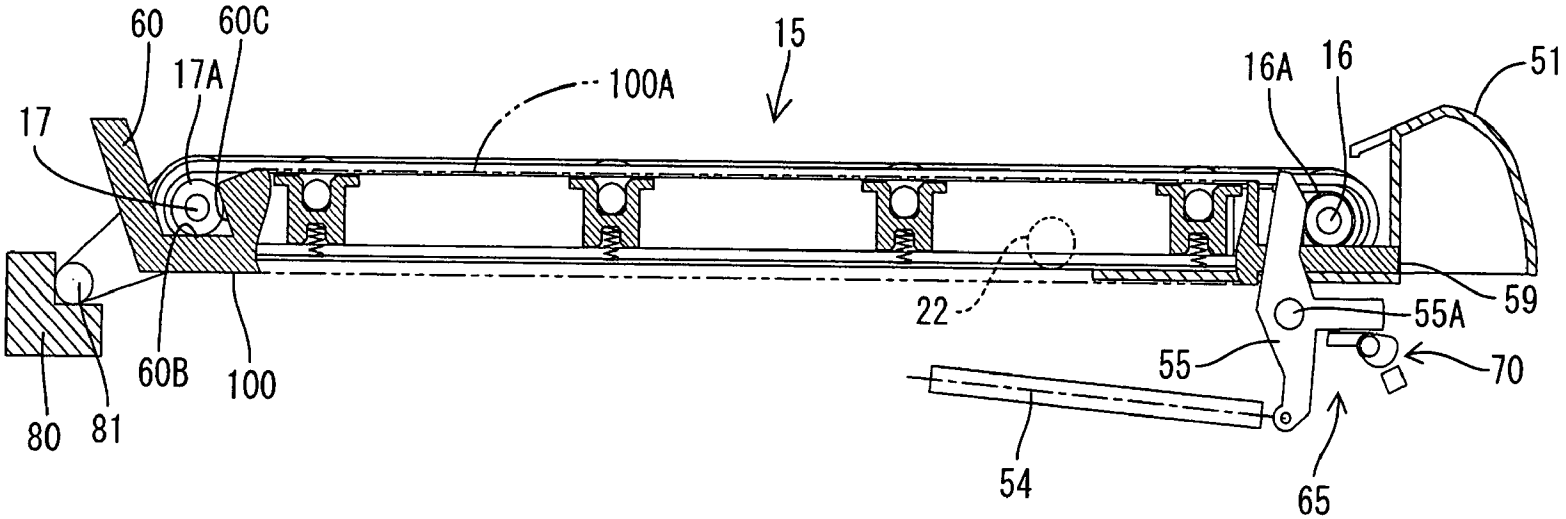
FIG. 9A is a partial sectional view showing detachment of the belt unit.

Referring to FIG. 9A, provided at a position opposite to the side at which the guide member 51 is provided for the belt unit 15 are a pair of shafts 81 (corresponding to the pivot shaft) supported at the different position (downward of the plane on which the support rollers 16 and 17 are arranged) from that of the roller shaft 17A (rotary shaft) of the support roller 17 at a pair of left and right support portions 80 (omitted in FIGS. 1, 2, and 5) provided at the main body. The shafts 81 extend in parallel with the roller shaft 17A (rotary shaft) of the support roller 17, each having the lower rear portion of its outer end portion supported at the pair of support portions 80. The main body of the apparatus in the invention represents the portion of the image forming apparatus other than the belt unit.

Figure 9B:
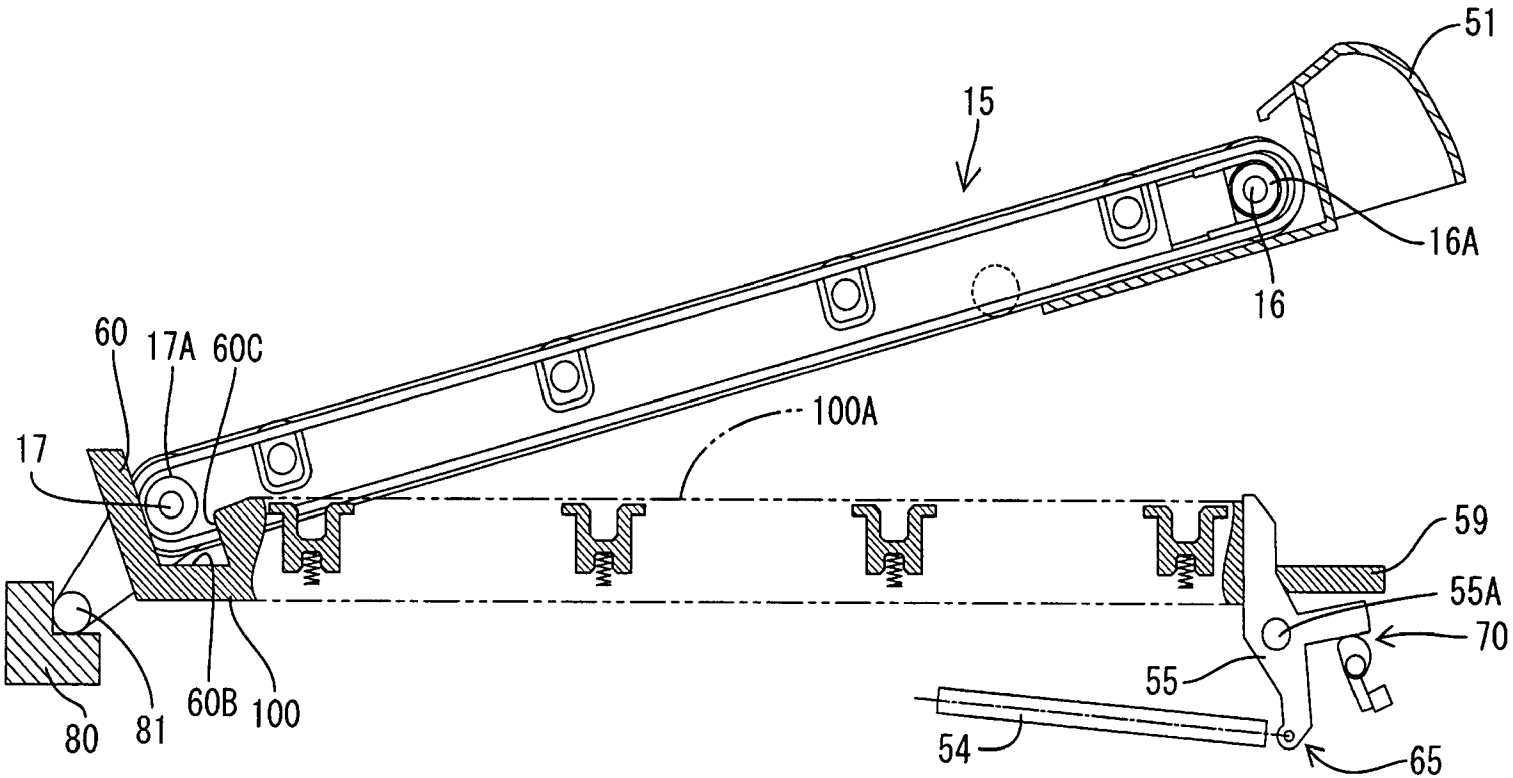
FIG. 9B is a partial sectional view showing the detachment of the belt unit.
Figure 10:
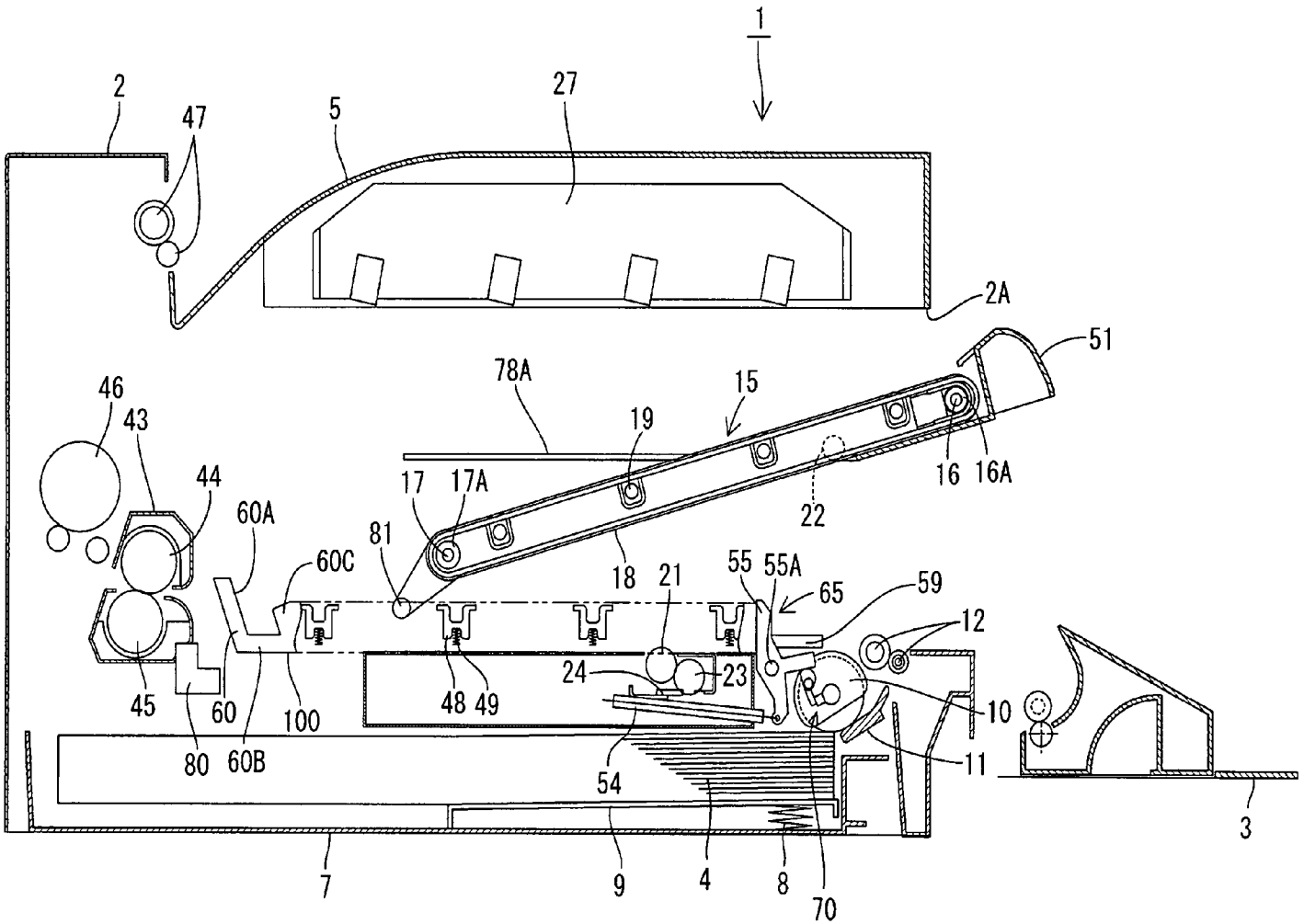
FIG. 10 is a sectional side elevation view of the structure at one side showing the state where the belt unit is detached from the body casing.

Referring to FIG. 9B, when the guide member 51 is lifted up, the belt unit 15 is guided to turn upward around the shaft 81 supported at the support portion 80 such that most part of the belt unit 15 is introduced into the accommodation space for the image forming unit 78. Concurrently, the roller shaft 17C of the support roller 17 and the bearing portion 17A displace upward to be out of the guide groove 60A of the unit support portion 60. The bearing portion 17A is positioned on an upper end surface 100A (see FIGS. 4 and 9B) of the frame 100 integrally provided with the unit support portions 59 and 60. When the belt unit 15 is withdrawn in the aforementioned state, it is guided by the upper end surface 100A of the frame 100 so as to be completely detached from the installed position. The detached belt unit is then withdrawn outside the main body through the opening 2A.

Meanwhile, in order to install the belt unit 15 in the body casing 2, the rear end portion of the belt unit 15 is inserted through the opening 2A to allow the bearing portions 17A at both ends of the rear support roller 17 to be placed on the upper surface 100A of the frame 100, and to slide inward until it is engaged with the guide groove 60A of the unit support portion 60. The bearing portions 16A at both ends of the front support roller 16 are positioned on the unit support portion 59. The lever 55 then presses the bearing portions 16A forward under the urging force of the coil spring 54 so as to be brought into the tensile force applied state where the tensile force is applied to the carrier belt 18. Accordingly, the belt unit 15 is stably located within the body casing 2.

The structure of the disclosure allows the image forming unit 78 above the belt unit 15 to be detached through the opening 2A such that the belt unit 15 is removed through the accommodation space for the image forming unit. This may allow the detachment and attachment of the belt unit 15 in the large space, thus providing excellent workability. The mechanism for guiding and locating the belt unit 15 may be simply structured.

The bearing portion 17A, with a constant positional relationship with the roller portion 17B of the support roller 17, is urged against the unit support portion 60 while being stably interposed between the bottom surface 60B and the front surface 60C by the resultant reaction force. The bearing portions 17A are pressed against the support roller 16 so as to be stably located with respect to the direction opposite to the support rollers 16 and 17, and stably located with respect to the direction perpendicular to the opposite direction through gripping with the reaction force generated by the pressing force. Accordingly, the support roller 17 may be reliably located to the main body of the apparatus with high accuracy.

The unit support portion 59 that supports the support roller 16 from one side, and the lever 55 that supports the support roller 16 from the side different from the aforementioned side such that the angle formed by the wall surface 59A of the unit support portion 59 and the wall surface of the lever 55 is smaller than 90°. The support roller 16 may be supported from two different directions so as to be stably located likewise the support roller 17.

The virtual plane F formed by connecting the rotary shafts of the support rollers 17 and 16 extends in substantially parallel with the wall surface of the bottom surface 60B. The front surface 60C has a wall surface inclined to the virtual plane. In the case where the bearing portions 17A moves to slightly approach or away from the support roller 16, it is expected to move along the wall surface of the bottom surface 60B in parallel with the virtual plane F. Accordingly, the support roller 17 itself hardly displaces in the direction perpendicular to the virtual plane F.

Under the urging of the coil spring 54, the force is applied to the support roller 17 so as to move away from the support roller 16. The structure allows the urging required for applying the tensile force to be used for locating while realizing the structure capable of applying the tensile force to the carrier belt 18 in a preferred mode.

The force directed to the support roller 16 is applied to the roller shaft 17C of the support roller 17 in accordance with the drive force transferred from the second gear 92 to the first gear 90. Accordingly, the force resulting from the gear transfer is applied as well as the urging of the coil spring 54. Therefore, the roller shaft 17C of the support roller 17 can be stably located.

The belt unit 15 is turned around the shaft 81 so as to detach the roller shaft 17C of the support roller 17 from the unit support portion 60, thus making the detaching operation performed by the operator convenient.

The second gear 92 is designed to give the thrust force to the first gear 90 along at least the roller shaft 17C of the support roller 17. Meanwhile, the main body is provided with the external terminal portion 95 that is electrically coupled with the roller shaft 19A while urging the roller shaft 19A of the transfer roller 19 in the same direction as that of the thrust force. The thrust force provided through the gear transfer of the first and the second gears 90 and 92, and the urging force applied by the external terminal portion 95 may be used to press the belt unit 15 toward one direction. This makes it possible to effectively prevent wobbling of the belt unit 15 after the installation. The entire apparatus, thus, may be located stably with high accuracy. The transfer roller 19 corresponds to the electric component, and the roller shaft 19A corresponds to the terminal portion in the invention, respectively.

As the wall surface of the bottom surface 60B is in parallel with the wall surface 59A of the unit support portion 59, the support rollers 17 and 16 hardly displace in the direction perpendicular to the opposite direction, and may be located stably with high accuracy in the perpendicular direction. This makes it possible to retain the movement direction of the belt constant with high accuracy.

Further, the bearing portion 17A of the belt unit 15 is engaged with the guide groove 60A of the unit support portion 60, and the bearing portion 16A is positioned on the unit support portion 59. In such a state, the release lever 73 is turned to rotate the cams 72 to move away from the lever 55. This makes it possible to realize the tensile force applied state in which the tensile force is applied to the carrier belt 18 by the lever 55 that presses the bearing portion 16A under the urging force of the tensile coil spring 54, and the located state in which the belt unit 15 is located in the body casing 2 simultaneously.

When the release lever 73 is turned in the opposite direction as described above, the lever 55 is turned against the urging force of the tensile coil spring 54 so as to release both the tensile force applied state with respect to the carrier belt 18 and the located state of the belt unit 15 within the body casing 2 simultaneously.

The unit support portion 60 is structured such that the angle formed by the horizontal bottom surface 60B and the front surface 60C is approximately 70°, and the angle formed by the surface of the lever 55 against which the bearing portion 16A abuts in the tensile force applied state and the upper surface of the horizontal unit support portion 59 is approximately 80°. This makes it possible to locate the belt unit 15 within the body casing 2 in the vertical and longitudinal directions.

Additionally, in the release mechanism 70, the lever 55 abuts against the maximum diameter point P of the cam 72 by turning the release lever 73. Then the lever 55 is turned to reach the position away from the bearing portion 16A. At the position where the maximum diameter point P is away from the lever 55, the movement of the cam 72 is restricted by the stopper 75 so as not to be further turned. This makes it possible to retain the lever 55 released from the tensile force applied state and the located state away from the bearing portion 16A. This makes the installation of the belt unit 15 easier.

In the disclosure, the length of the release lever 73 is adjusted such that the operation load to the release lever 73 required for releasing the tensile force applied state is equal to or lighter than 1 kg, and becomes equal to or half of the load applied from the tensile coil spring 54 to the bearing portion 16A in the tensile force applied state. It may be set by making the length of the release lever 73 with respect to the maximum diameter of the cam 72 to a certain degree. The above described structure enhances both the tensile force application to the carrier belt 18 and location of the belt unit 15 with the tensile coil spring 54 that exhibits the strong elastic force. Meanwhile, the structure is capable of releasing such states at the relatively lighter operation load.

The release lever 73 has both ends connected to the pair of left and right cams 72, 72 that interpose the belt unit 15 therebetween. Operation of the single release levers 73 releases the pair of left and right release structures 70 and 70 simultaneously, resulting in high workability.

Figure 11:
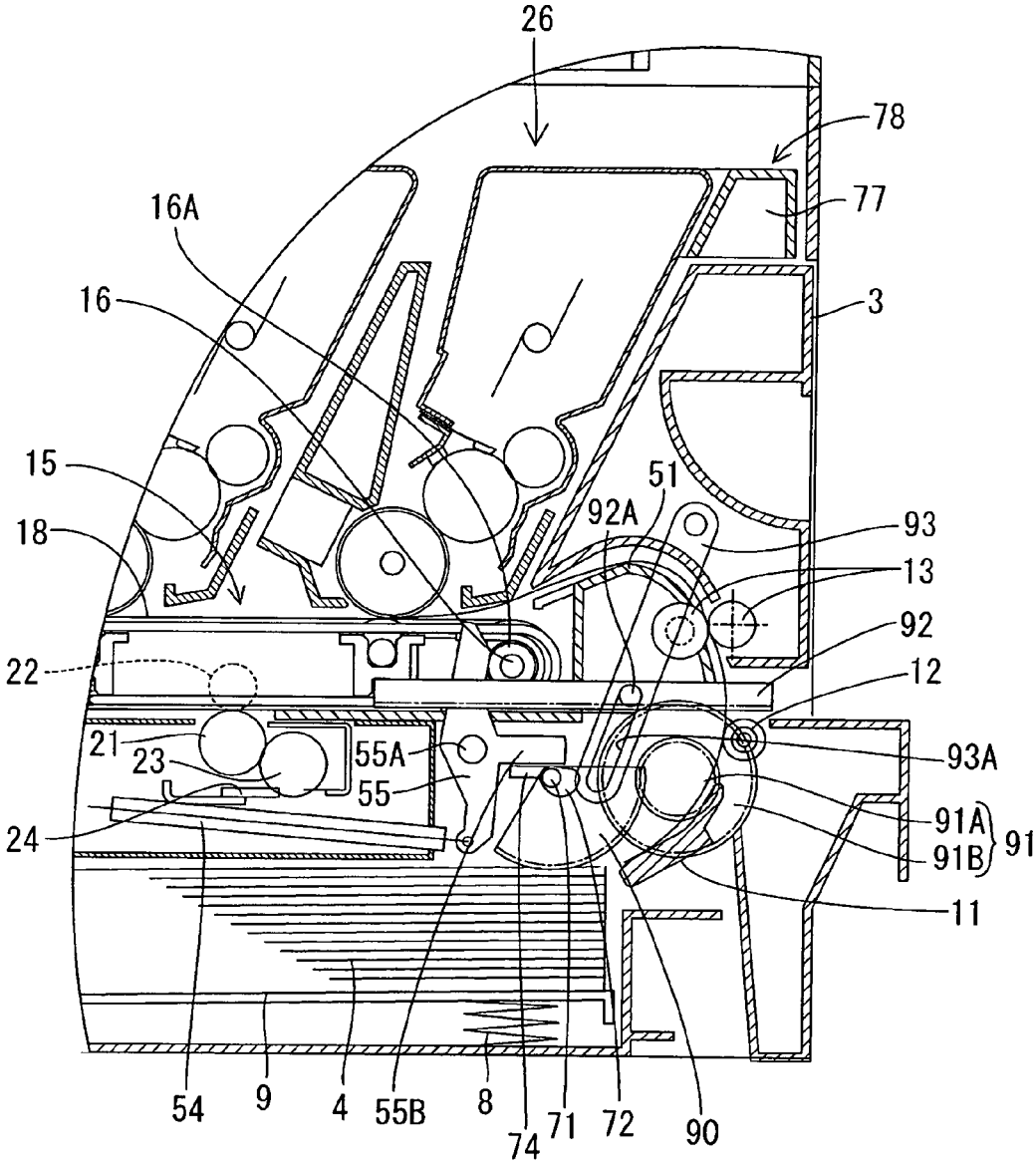
FIG. 11 is a sectional side elevation view of a laser printer at one side according to another aspect of the invention having the front cover closed.
Figure 12:
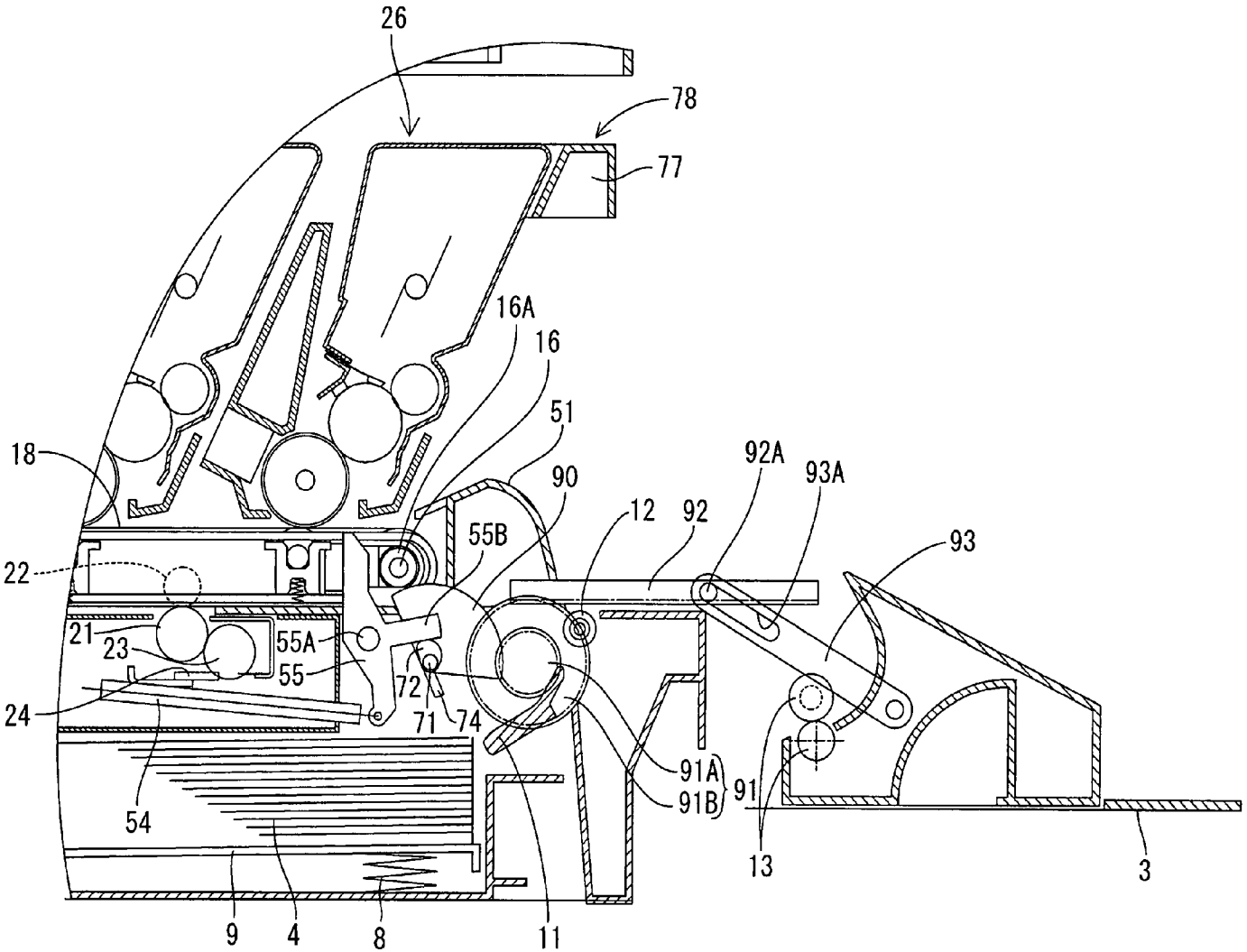
FIG. 12 is a sectional side elevation view of the laser printer at one side in the state which is changed from the one shown in FIG. 11 and where the front cover is opened.

FIGS. 11 and 12 show another configuration of the present invention. The same elements as those described referring to FIGS. 1 to 10 are designated with the same reference numerals, and the description thereof, thus, will be omitted. Only the aspects different from the aforementioned disclosure will be described. Although the pick-up roller 10 is actually provided in the present disclosure, it is omitted in FIGS. 11 and 12.

Referring to FIGS. 11 and 12, instead of the release lever 73, a fan-like first gear 90 that rotates integrally with the pair of left and right cams 72, and a second gear 91 formed of a small gear 91A and a large gear 91B meshed with the first gear 90 are provided so as to be rotatable around the rotary shaft in the lateral direction.

Pair of slide members 92 that interpose the belt unit 15 therebetween are moveably provided to the body casing 2 in the longitudinal direction above the second gear 91. The slide member 92 has a plurality of tooth meshed with the large gear 91B of the second gear 91 are arranged on the lower surface in the longitudinal direction. The slide member 92 is provided with an engagement pin 92A that has been inserted into a long hole 93A formed in the leading end of an arm 93 having its base end rotatably attached to the front cover 3.

In the aforementioned structure, referring to FIG. 11 showing the state where the front cover 3 is closed, the large diameter portion 72A of the cam 72 is at the position away from the lever 55, and the urging force of the tensile coil spring 54 is applied to the bearing portion 16A via the lever 55 so as to bring the structure into the tensile force applied state where the tensile force is applied to the carrier belt 18.

Referring to FIG. 12, when the front cover 3 is opened, the slide member 92 is withdrawn forward by the arm 93 connected to the front cover 3. Then the large gear 91B of the second gear 91 meshed with the slide member 92 rotates clockwise. Then the first gear 90 meshed with the small gear 91A of the second gear 91 rotates counterclockwise. The cams 72 rotate along with the aforementioned rotating operation such that the lever 55 moves away from the bearing portion 16A by the large diameter portion 72A so as to release both the tensile force applied state and the located state simultaneously.

When the front cover 3 is closed, the operation reverse to the one performed when the front cover 3 is opened is performed. As a result, the tensile force applied state and the located state, in which the lever 55 abuts against the bearing portion 16A may be restored simultaneously.

As described above, according to the disclosure, opening and closing of the front cover 3 can achieve and release the tensile force applied state and the located state with respect to the belt unit 15.

Another configuration of the present invention is shown in FIGS. 13 to 15B. The same elements as those described above are designated with the same reference numerals, and the description thereof, thus, will be omitted. Only the part different from the aforementioned configurations will be described. Although the pick-up roller 10 actually forms part of the present invention, it is omitted in FIGS. 13 to 15B.

In the disclosure, instead of the release lever 73, a fan-like first gear 140 that rotates integrally with the pair of left and right cams 72, and a second gear 141 formed of a small gear 141A and a large gear 141B meshed with the first gear 140 are provided so as to be rotatable around the rotary shaft in the lateral direction.

Bar-like sliders 142 are provided to rotate the second gears 141 corresponding to the pair of the second gears 141 respectively, each of which is inclined having the obliquely upward front side on the lower surface of the front of the image forming unit 78. Each of the sliders 142 has a plurality of teeth meshed with the large gear 141B of the second gear 141 arranged in the longitudinal direction on the lower surface.

Figure 13:
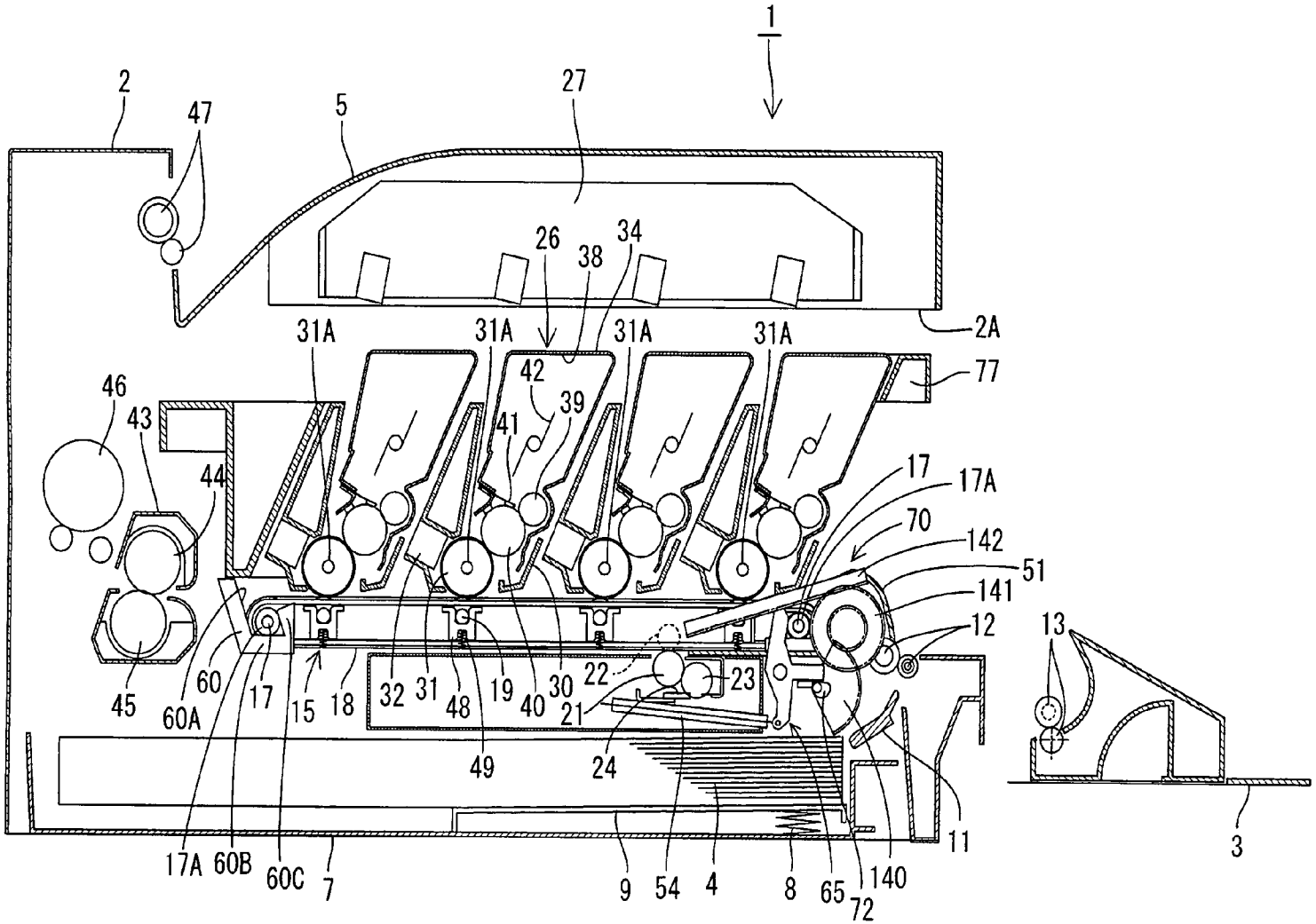
FIG. 13 is a sectional side elevation view of a laser printer at one side according to another aspect of the invention in the state where the image forming unit is installed in the body casing.
Figure 14:
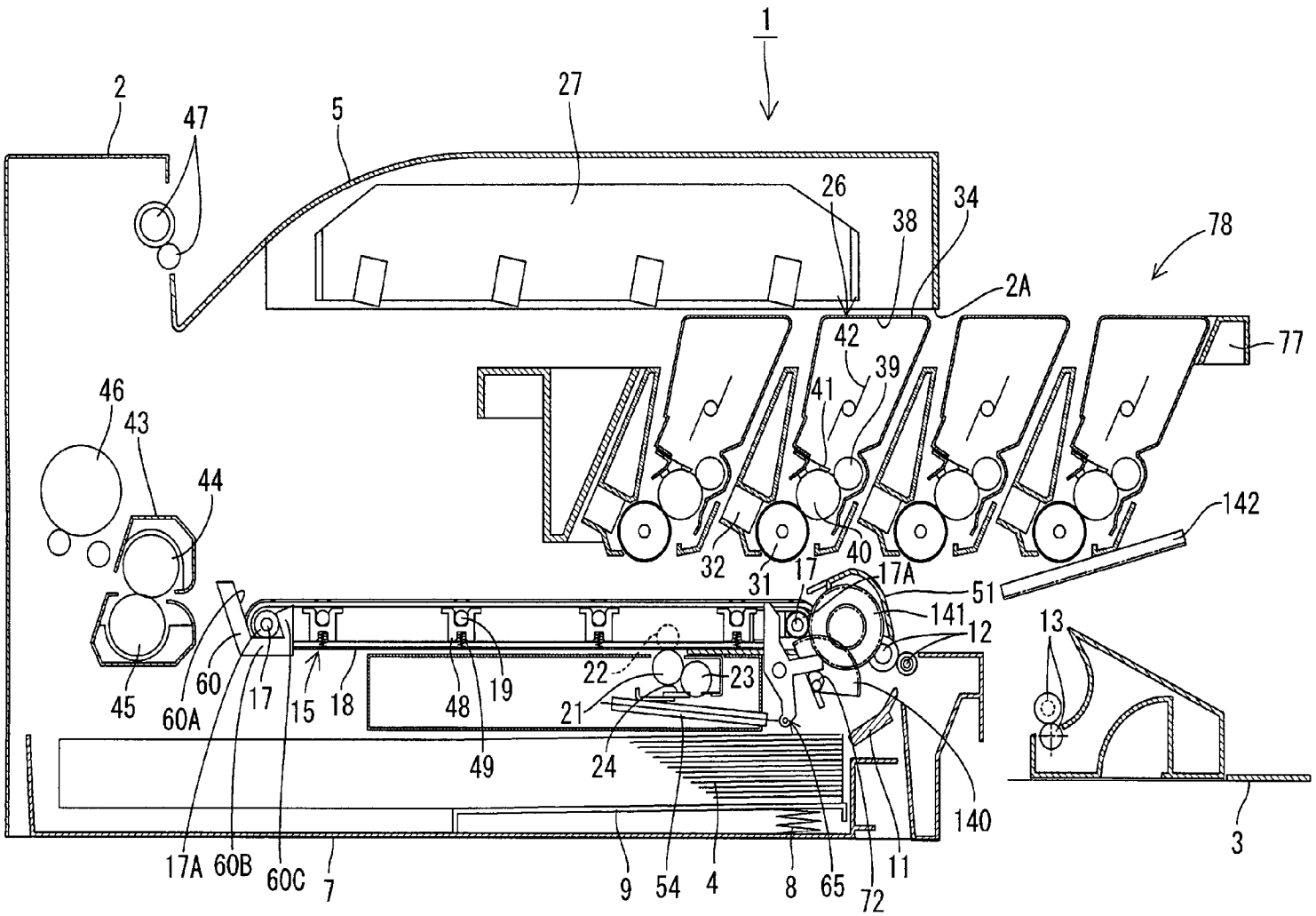
FIG. 14 is a sectional side elevation view of the laser printer at one side in the state which is changed from the one shown in FIG. 13 and where the image forming unit is detached.
Figure 15A:
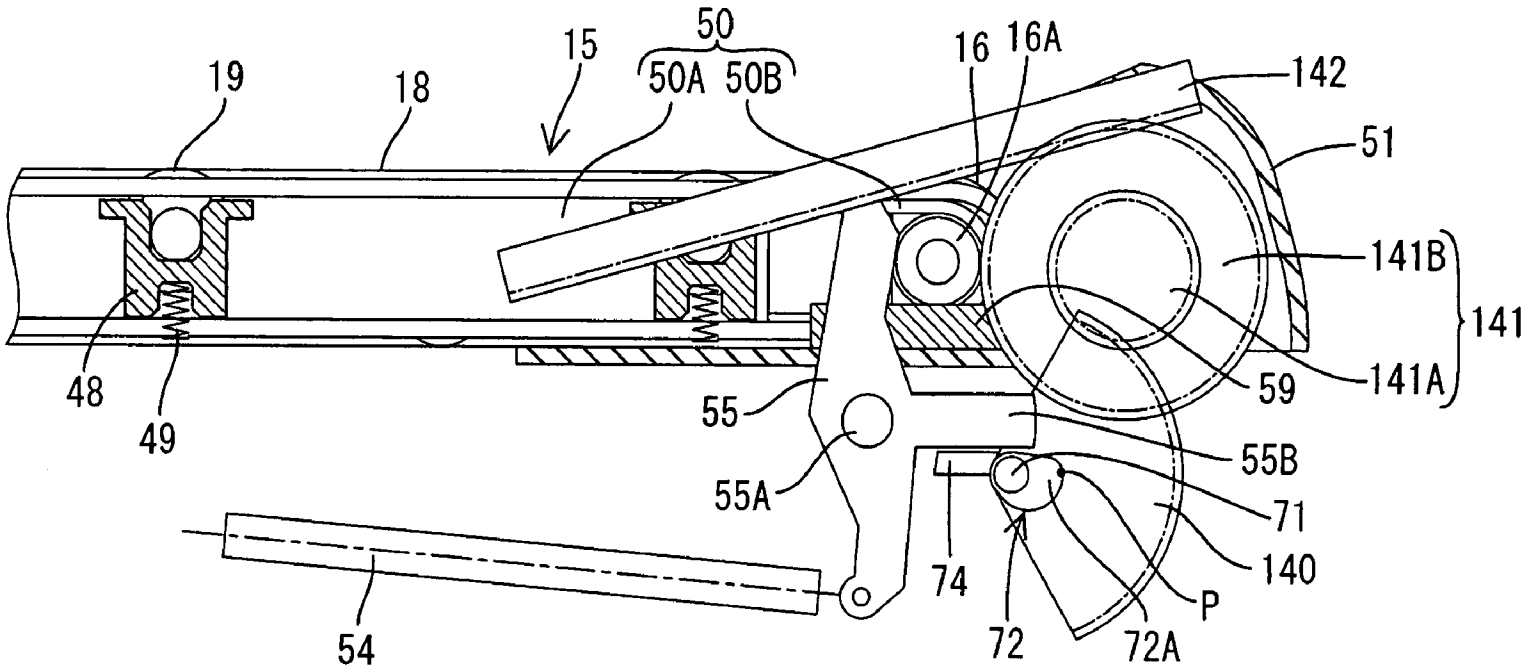
FIG. 15A is an enlarged sectional view of the front end portion, tensile force application mechanism, and a slider of the belt unit.

In the state where the image forming unit 78 is installed within the body casing 2 of the aforementioned structure as shown in FIGS. 13 and 15A, the large-diameter portion 72A of the cam 72 is positioned away from the lever 55. The urging force of the tensile coil spring 54 is applied to the bearing portion 16A via the lever 55 so as to bring the structure into the tensile force applied state where the tensile force is applied to the carrier belt 18.

Figure 15B:
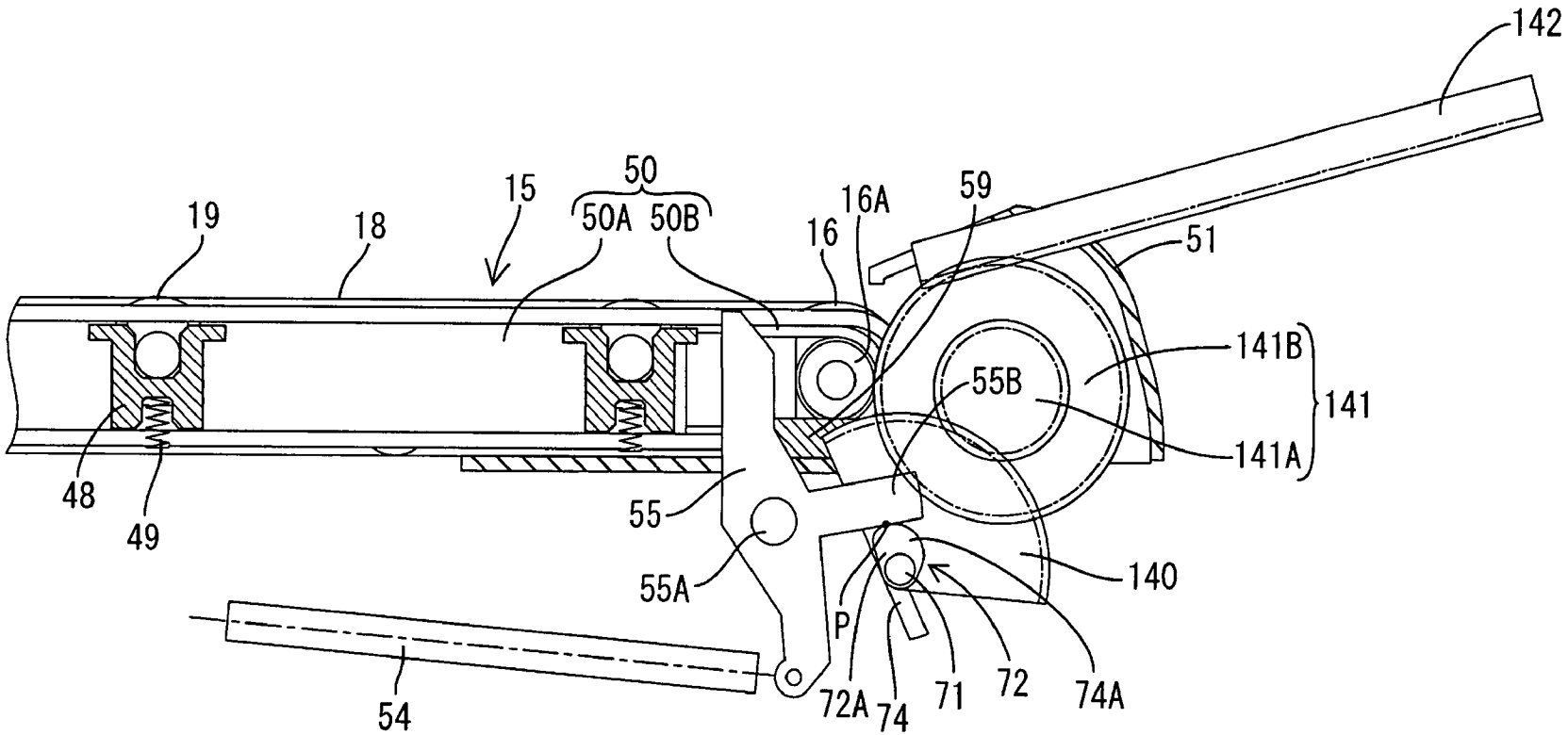
FIG. 15B is an enlarged sectional view of the front end portion, tensile force application mechanism, and the slider of the belt unit.

As the image forming unit 78 is withdrawn from the body casing 2, the image forming unit 78 is guided by a guide groove (not shown) formed in each of the left and right inner walls of the body casing 2 so as to move obliquely upward in the forward direction while keeping its position horizontal. Referring to FIG. 15B, the slider 142 moves obliquely upward in the forward direction, and the large gear 141B of the second gear 141 meshed with the slider 142 rotates clockwise. Then the first gear 140 meshed with the small gear 141A of the second gear 141 rotates counterclockwise. The cams 72 rotate accompanied with the aforementioned rotations such that the lever 55 moves at the position away from the bearing portion 16A by the large diameter portion 72A so as to release the tensile force applied state and the located state simultaneously. The image forming unit 78 is then guided forward along the guide groove so as to be completely detached from the body casing 2 (see FIG. 14).

When the image forming unit 78 is inserted into the body casing 2, the operation reverse to the one performed when it is withdrawn from the body casing 2 will be performed so as to restore the tensile force applied state and the located state where the lever 55 abuts against the bearing portion 16A simultaneously.

This configuration allows the belt unit 15 to be brought into the tensile force applied state and the located state, and to be released therefrom accompanied with the attachment and detachment of the image forming unit 78.

Figure 16A:
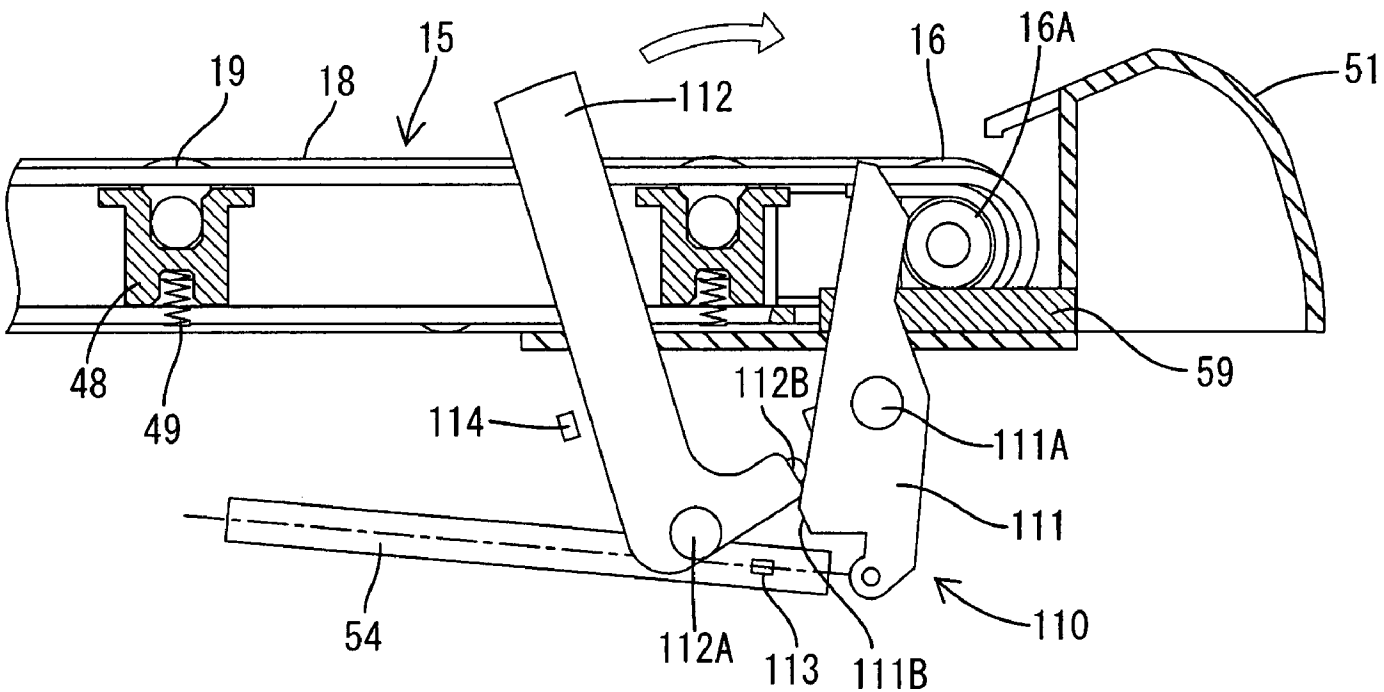
FIG. 16A is a partial sectional view of a laser printer according to another aspect of the invention showing the front end portion of the belt unit in the state where the tensile force is applied.
Figure 16B:
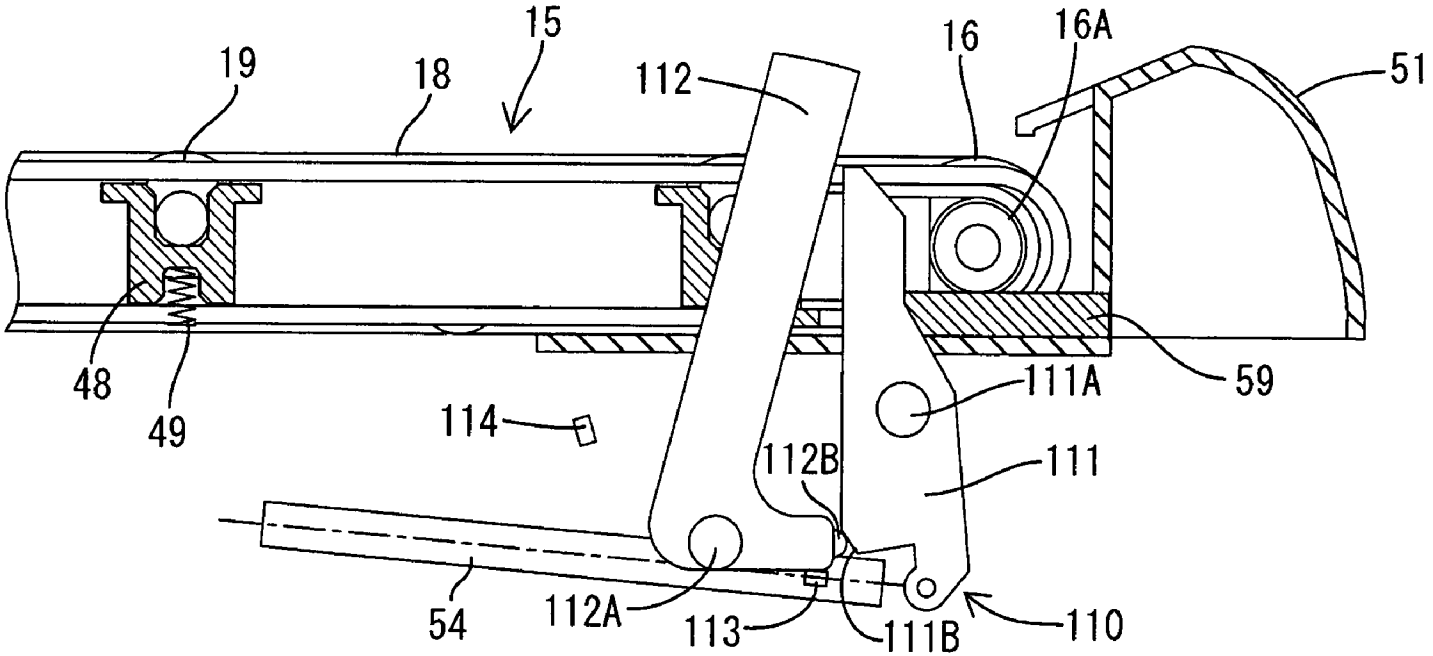
FIG. 16B is a partial sectional view of the laser printer according to another aspect of the invention showing the front end portion of the belt unit in the state where the tensile force is released.

Further, another configuration according to the present invention is shown in FIGS. 16A and 16B. The same elements as those described above are designated with the same reference numerals, and the description thereof will be omitted. Only the part different from the aforementioned configurations will be described.

A tensile force application mechanism 110 of the disclosure is provided with a pair of levers 111 and 111 (corresponding to the second abutment portions), each center of which is rotatably supported at a rotary shaft 111A along the lateral direction, and a pair of tensile coil springs 54 and 54 that urge the levers 111, respectively.

The tensile coil spring 54 has a rear end fixed to the side of the body casing 2, and a front end as a free end connected to the lower end portion of each of the respective levers 111. The levers 111 have upper end portions swingable against the elastic force applied by the tensile coil spring 54. Two pairs of the levers 111 and the tensile springs 54 are arranged such that the front end of the accommodated belt unit 15 is interposed between the pair of the levers 111.

An L-like press member 112 is provided at the rear portion of the lever 111. The press member 112 has a bent portion rotatably supported at a rotary shaft 112A along the lateral direction. A press portion 112B which has a spherical end extending forward is allowed to abut against the lever 111 at the lower surface of the rotary shaft 111A from the direction opposite to the rotating direction (rearward) of the lever 111 to which the urging force of the tensile coil spring 54 is applied.

Referring to FIG. 16A, the lever 111 is allowed to turn in the direction of the turn under the urging force of the tensile coil spring 54 (clockwise as shown in the drawing) in the tensile force applied state where it abuts against the bearing portion 16A to apply the tensile force to the carrier belt 18. Stopper 114 is provided to prevent the press member 112 from turning further counterclockwise from the position shown in the drawing. When the upper end portion of the press member 112 is moved forward as shown in FIG. 16B, the lever 111 receives the pressing force upon movement of the upper end portion of the press member 112 forward, and rotates in the direction against the urging force of the tensile coil spring 54 (counterclockwise in the drawing) so as to move away from the bearing portion 16A. When the upper end portion of the press member 112 is further moved forward, the press portion 112B abuts against a notch portion 111B of the lever 111 to receive the clockwise rotating force resulting from the urging force of the tensile coil spring 54. The further rotation of the press member 112 is restricted by a stopper 113. This makes it possible to retain the tensile force applied state released.

Conversely when the upper end portion of the press member 112 is moved rearward, the press portion 112B runs on the notch portion 111B, and receives the counterclockwise rotating force under the urging force of the tensile coil spring 54. The lever 111 is allowed to turn in the direction of the urging force of the tensile coil spring 54 so as to release the tensile force applied state and the located state simultaneously.

Figure 17A:
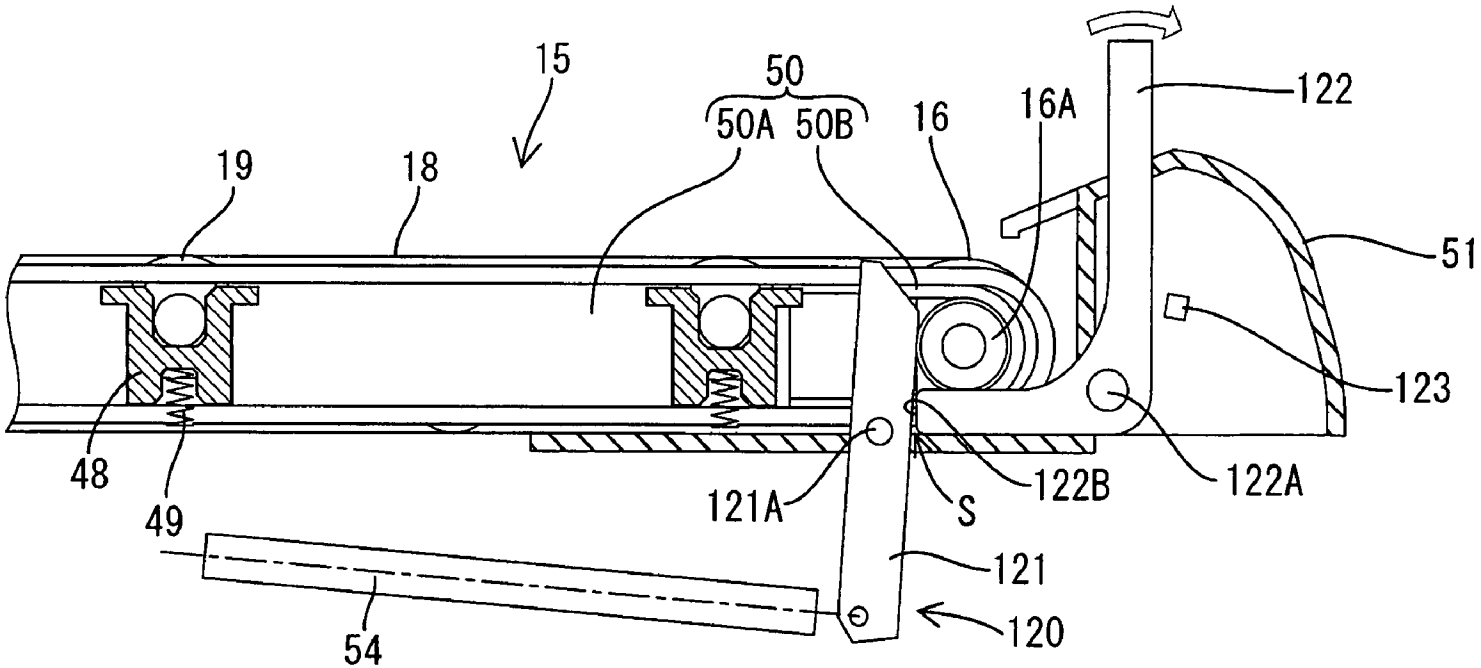
FIG. 17A is a partial sectional view of a laser printer according to another aspect of the invention showing the front end portion of the belt unit in the state where the tensile force is applied.
Figure 17B:
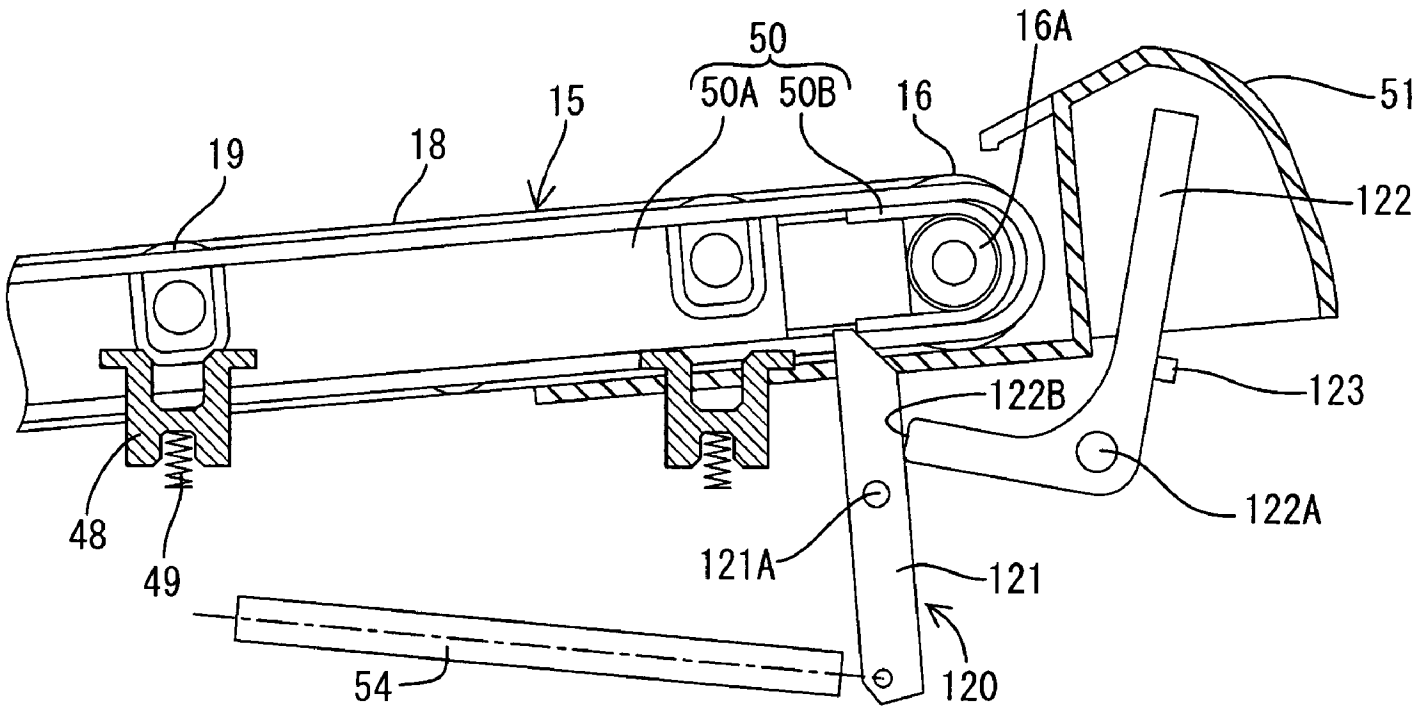
FIG. 17B is a partial sectional view of the laser printer according to another aspect of the invention showing the front end portion of the belt unit in the state where the tensile force is released.

Another configuration according to the present invention is shown in FIGS. 17A and 17B. The same elements as those described above are designated with the same reference numerals, and the description thereof will be omitted. Only the part different from the aforementioned disclosure will be described.

A tensile force application mechanism 120 is provided with a pair of levers 121 and 121 (corresponding to the second abutment portions), each center of which is rotatably supported at a rotary shaft 121A along the lateral direction, and a pair of tensile coil springs 54 and 54 that urge the levers 121 and 121, respectively.

Each of the tensile coil springs has a rear end portion fixed to the body casing 2, and a front end portion as a free end connected to the lower end portion of each of the levers 121. The lever 121 has the upper end portion swingable against the elastic force of the tensile coil spring 54. Two pairs of the levers 121 and the tensile coil springs 54 are arranged such that the front end portion of the accommodated belt unit 15 is interposed between the pair of the levers 121.

L-like operation levers 122 are provided to the front of the respective levers 121. Each of the respective operation levers 122 has a bent portion rotatably supported at a rotary shaft 122A along the lateral direction. A press portion 122B at one end directed rearward is allowed to abut against the lever 121 above the rotary shaft 121A from the direction (forward) opposite to the rotating direction of the lever 121 under the urging force of the tensile coil spring 54.

Referring to FIG. 17A, the lever 121 is allowed to turn in the rotating direction (clockwise) by the urging force of the tensile coil spring 54 in the tensile force applied state where it abuts against the bearing portion 16A positioned on the unit support portion 59, and the tensile force is applied to the carrier belt 18. Meanwhile, referring to FIG. 17B, when the upper end portion of the operation lever 122 is moved forward, the bearing portion 16A is lifted up by the operation lever 122, and rotates in the direction (counterclockwise) against the urging force of the tensile coil spring 54 in response to reception of the pressing force of the press portion 122B. The lever 121 is, thus, moved away from the bearing portion 16A. As the upper portion of the operation lever 122 is further moved forward, the press portion 122B abuts against the upper end of the lever 121 to receive the clockwise rotating force under the urging force of the tensile coil spring 54. Further turning of the operation lever 122 is restricted by the stopper 123.

In the tensile force applied state shown in FIG. 17A, a gap S between the press portion 122B and the lever 121 to the slight degree allows the lever 121 to turn under the urging force of the tensile coil spring 54. Meanwhile, in the released state as shown in FIG. 17B, the state where the operation lever 122 is prevented from turning clockwise under the urging force of the tensile coil spring 54, that is, the released state from the tensile force applied state is maintained.

Conversely, upon installation of the belt unit 15, when the bearing portion 16A is positioned on the unit support portion 59 while being engaged with the operation lever 122, the press portion 122B of the operation lever 122 moves to the position close to the rotary shaft 121A of the lever 121. The lever 121 is allowed to turn in the turning direction under the urging force of the tensile coil spring 54. Accordingly, the tensile force applied state and the located state may be realized simultaneously without directly operating the operation lever 122.

Figure 18A:
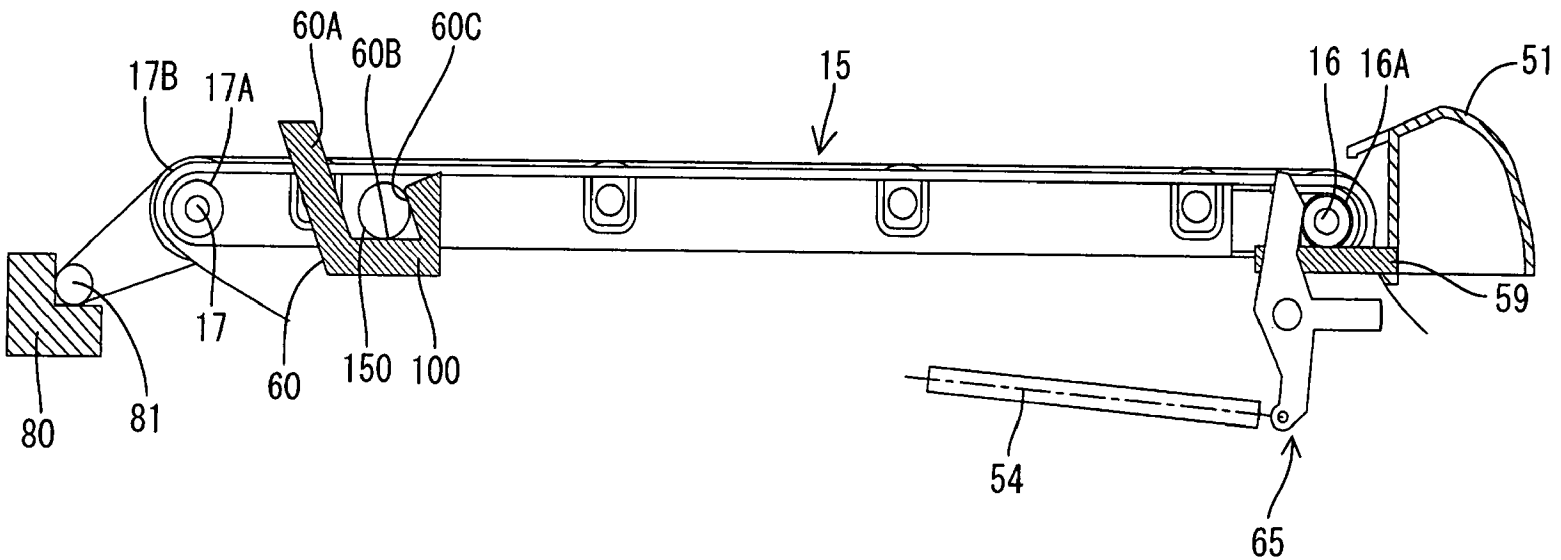
FIG. 18A is a partial sectional view of another aspect of the present invention with a different belt unit at an installed position.
Figure 18B:
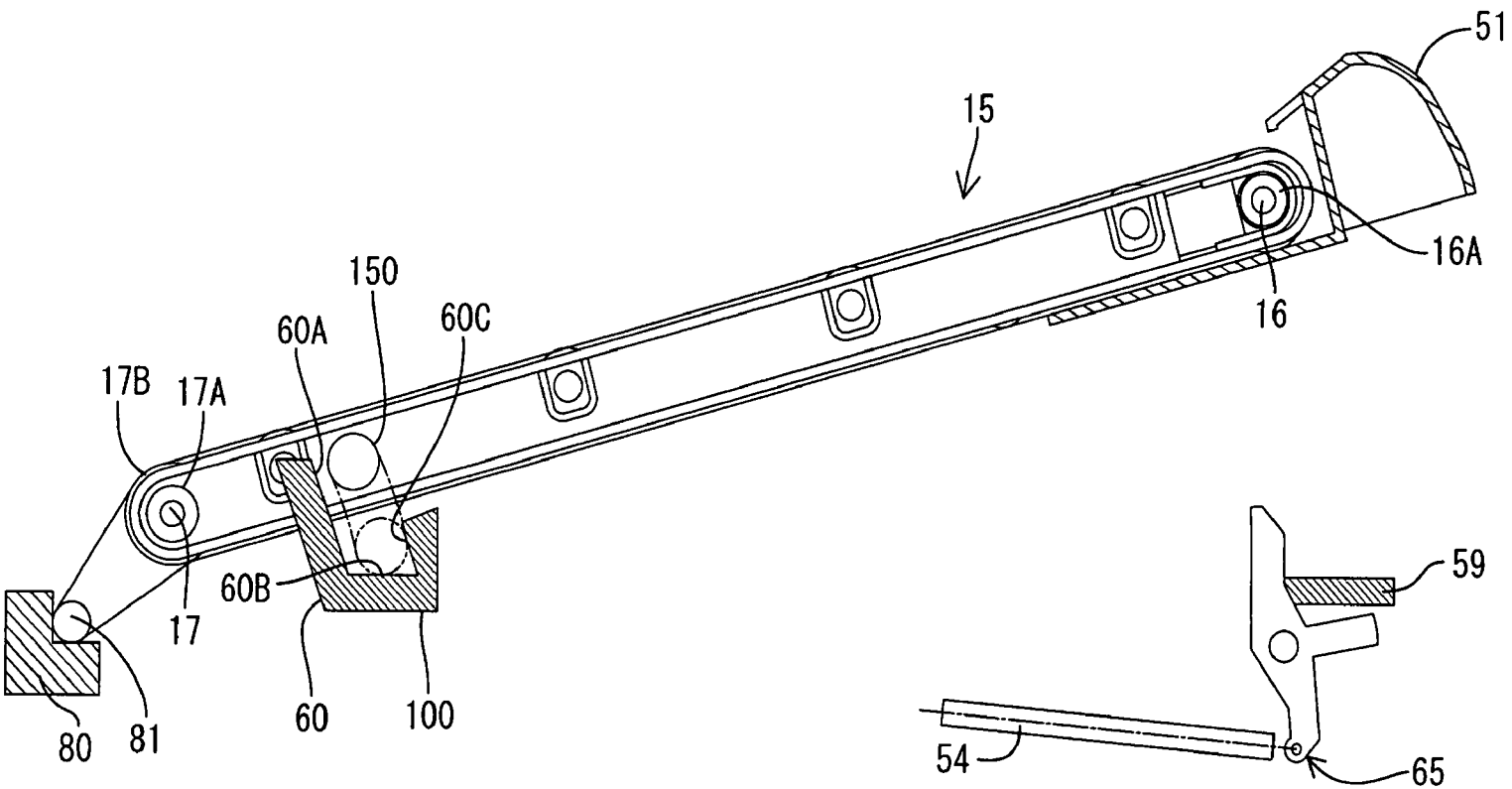
FIG. 18B is a partial sectional view of another aspect of the present invention with the different belt unit in the detachment process.

The bearing portion 17A is described above as being formed as a reference protrusion. However, the portion other than the bearing portion 17A may be formed as the reference protrusion so long as it has a constant positional relationship with the roller portion of the second support roller as shown in FIGS. 18A and 18B, for example.

This configuration is substantially the same as those shown in FIGS. 1 to 10 except that the pair of left and right protrusions 150 (only the protrusion at one side is shown in the drawing) are provided to the belt frame 50 of the belt unit 15. Accordingly, the same elements as those described above are designated with the same reference numerals, and the description thereof will be omitted. The protrusion 150 as the reference protrusion supported at the unit support portion 60 is structured so as to have a constant positional relationship with the roller portion 17B of the support roller 17 as the first support roller. The unit support portion 60 includes the bottom surface 60B as the first wall portion to support the protrusion 150 from one side, and the front surface 60C as the first abutment portion, which are arranged to form the angle smaller than 90° therebetween. The protrusion 150 is supported between the bottom surface 60B and the front surface 60C.

In the structure, the protrusion 150 and the support roller 16 are urged by the coil spring 54 so as to be moved away from each other, and the protrusion 150 serves to press the unit support portion 60 to the side of the support roller 16.

As described above, each of the first wall portion and the first abutment portion has a planar surface, and an angle smaller than 90° is formed thereby. However, at least one of the first wall portion and the first abutment portion may have the portion that abuts against the reference protrusion curved. In this case, the angle formed by the virtual planes in contact with the contact point between the first wall portion and the reference protrusion, and the contact point between the first abutment portion and the reference protrusion may be set to the value smaller than 90°.

Likewise, at least one of the second wall portion and the second abutment portion may have the portion that abuts against the reference protrusion curved. In this case, the angle formed by the virtual planes in contact with the contact point between the second wall portion and the reference protrusion, and the contact point between the second abutment portion and the reference protrusion may be set to the value smaller than 90°.

The guiding mechanism for guiding the belt unit 15 via the accommodation space for the image forming unit 78 may be structured to provide the arm member rotatably in the main body of the apparatus such that the belt unit 15 is guided by the arm member while engaging the belt unit 15 with the engagement portion formed in the arm member. In this case, the arm member may include a first arm member that guides an end portion of the belt unit 15 in one lateral direction, and a second arm member that guides the other end portion. It is preferable to join those first and the second arm members with a joint portion so as to be turned in association with each other. The aforementioned structure makes it possible to guide the belt unit 15 stably without bias, resulting in more accurate and easier operation.

A number of embodiments of the invention have been described. Nevertheless, it will be understood that various modifications may be made without departing from the spirit and scope of the invention. For example, the tunneling magnetoresistive sensor may be either a top or bottom tunneling structure, and the either the top shield or the bottom shield may wrap around the magnetoresistive stack. Depending on the intended application, the contact lead layout may also be altered to reduce lead resistance. Accordingly, other embodiments, such as that described below are within the scope of the following claims.

At least first and second support rollers may be provided as the roller for supporting the belt. The third support roller other than the aforementioned support rollers may be provided.

The structure may be applied to the image forming apparatus of intermediate transfer mode, which transfers the developer image on the intermediate transfer belt from the photoreceptor. In this case, the intermediate transfer belt may be formed as the "endless belt" for applying the invention.

The unit mechanism in the image forming apparatus includes the fixation unit, and the scanner unit that irradiates the laser light ray to the photosensitive drum unit in addition to the photosensitive drum unit and the belt unit. It may be structured to detach the scanner unit through the accommodation space for the photosensitive drum unit, or to detach the belt unit through the accommodation space for the fixing unit. They may be arbitrarily formed so long as a first unit accommodated in a first accommodation space communicated with the opening formed in the side of the main body is detached in order to take a second unit from the opening through at least a portion of the first accommodation space. The unit may be arbitrarily formed so long as a plurality of parts are assembled and integrated based on the intended function in need.

What is claimed is:

1. An image forming apparatus comprising:

a main body having an opening formed in a side portion, which contains a first accommodation space able to communicate with said opening and a second accommodation space able to communicate with at least said first accommodation space; and a first unit detachably installed in said first accommodation space within said main body through said opening;

a second unit detachably installed in said second accommodation space within said main body through said opening and comprising a belt unit including:

a belt;

a plurality of support rollers provided with at least first and second support rollers for supporting said belt; and a frame portion that retains said support rollers, wherein said second unit is detached and attached through at least a portion of said first accommodation space between said second accommodation space and said opening.

2. The image forming apparatus according to claim 1, wherein: said first unit is an image forming unit having a plurality of photosensitive drums arranged in a direction perpendicular to an axial direction of said photosensitive drums; and a guide member that slides along a linear direction formed by connecting at least two axes of said plurality of photosensitive drums to guide said image forming unit.

3. The image forming apparatus according to claim 1, wherein:

said belt unit is provided with a reference protrusion having a constant positional relationship with said first support roller;

said main body is provided with a first locate member including a first wall portion that supports said reference protrusion from one side and a first abutment portion provided at a side different from that of said first wall portion, and an urging member that applies an urging force such that said reference protrusion and said second support roller move away from each other; and said first locate member is structured such that an angle formed by a wall surface of said first wall portion and a wall surface of said first abutment portion is smaller than 90°, and said belt unit is located at an installed position by supporting said reference protrusion between said first wall portion and said first abutment portion under said urging force applied by said urging member.

4. The image forming apparatus according to claim 3, wherein said reference protrusion comprises a bearing portion that bears said first support roller.

5. The image forming apparatus according to claim 4, further comprising a second locate member, wherein: said second locate member includes a second wall portion that supports said second support roller from one side, and a second abutment portion that supports said second support roller from a side different from that of said second wall portion; and said second support roller is supported in a state where an angle formed by a wall surface of said second wall portion and a wall surface of said second abutment portion is smaller than 90°.

6. The image forming apparatus according to claim 5, wherein a virtual plane formed by connecting said reference protrusion and a rotary shaft of said second support roller is substantially in parallel with a wall surface of said first wall portion, and said first abutment portion has a wall surface inclined to said virtual plane.

7. The image forming apparatus according to claim 6, wherein a force is applied to said second support roller in a direction away from said reference protrusion under said urging force applied by said urging member.

8. The image forming apparatus according to claim 7, wherein:

a first gear is provided at a shaft portion of said first support roller;

a second gear is provided for transferring a drive force to said first gear; and a force directed toward said second support roller and said first wall portion is applied to said shaft portion of said first support roller in accordance with a drive force transferred from said second gear to said first gear.

9. The image forming apparatus according to claim 3, wherein:

a rotary shaft is provided such that it protrudes at an end portion of said frame portion of said belt unit, which is opposite to said opening, and a support portion is provided at a side of said main body for supporting said rotary shaft; and an end portion at said opening of said belt unit is pivotally driven into an accommodation space for said belt unit such that said reference protrusion moves away from said first locate member.

10. The image forming apparatus according to claim 8, wherein:

said belt unit includes an electrically connectable terminal portion, and an electric part to which an electric power is supplied from outside said belt unit via said terminal portion;

said second gear applies a thrust force along at least said shaft portion of said first support roller to said first gear; and an external terminal portion that is electrically connected to said terminal portion while urging said terminal portion in a same direction as that for applying said thrust force is provided in said main body to which said belt unit is installed.

11. The image forming apparatus according to claim 10, wherein:

a shaft portion of said second support roller is supported at a planar surface;

said urging member urges a shaft portion of said second support roller along said planar surface in a direction away from said reference protrusion; and a wall surface of said first wall portion is in parallel with said planar surface.

12. The image forming apparatus according to claim 1, wherein:

said belt unit is provided with a first bearing member that bears said first support roller and includes a first reference protrusion, and a second bearing member that is moveably attached to said frame relative to said first bearing member to bear said second support roller and includes a second reference protrusion;

said main body is further provided with:

a first locate member including a first wall portion on which said first reference protrusion is positioned, and a first abutment portion that abuts against said first reference protrusion at a plane opposite to said second reference protrusion;

a second locate member including a second wall portion on which said second reference protrusion of said second bearing member is positioned, and a second abutment portion that abuts against said second reference protrusion at a plane opposite to said first reference protrusion;

an urging member that moves said second abutment portion of said second locate member to apply a tensile force to said belt; and a release mechanism that is brought into a released state in which said second abutment portion is moved against an urging force of said urging member upon reception of an operation force.

13. The image forming apparatus according to claim 12, wherein said second reference protrusion comprises a bearing portion that is positioned adjacent said second support roller of said second bearing member.

14. The image forming apparatus according to claim 13, wherein said first reference protrusion comprises a bearing portion that bears said first support roller of said first bearing member.

15. The image forming apparatus according to claim 13, wherein said first reference protrusion is provided at a position closer to said second reference protrusion of said second bearing member than a bearing portion of said first bearing member.

16. The image forming apparatus according to claim 15, wherein said belt unit is accommodated in said main body, and a distance between upper end sides of said abutment portions of said first and second locate members is longer than a distance between said first and second reference protrusions when said release mechanism is in a located state where said release mechanism is not in said released state.

17. The image forming apparatus according to claim 16, wherein said belt unit is accommodated in a body casing, and an angle formed by said first wall portion and said first abutment portion is smaller than 90°, and an angle formed by said second wall portion and said second abutment portion is smaller than 90° in a located state where said release mechanism is not in said released state.

18. The image forming apparatus according to claim 17, further comprising a retention mechanism that retains said release mechanism in said released state.

19. The image forming apparatus according to claim 18, wherein:

said second abutment portion is rotatably supported at a side of said body casing against an urging force of said urging member;

said retention mechanism includes a press member that eccentrically rotates in response to said operation force so as to be allowed to press said second abutment member; and said press member presses said second abutment portion when said release mechanism is in said released state, and a pressing force contains a component against a rotating component of said second abutment portion of a restoring force of said urging member.

20. The image forming apparatus according to claim 19, further comprising a release lever that applies said operation force to said release mechanism in response to a predetermined operation, wherein an operation load of said release lever required for releasing said release mechanism is equal to or less than half of a load applied to said second reference protrusion of said second bearing member by said urging member in a located state where said release mechanism is not in a released state.

21. The image forming apparatus according to claim 19, wherein:

pairs of said second locate member and said release mechanism are provided at both ends of said belt unit so as to interpose said belt unit; and said release mechanism is integrally provided with said release lever, said release lever applies said operation force to said release mechanism at both sides.

22. The image forming apparatus according to claim 21, wherein said release mechanism is operated in association with an opening operation of an opening and closing cover provided to said body casing and is opened and closed for detachment and attachment of said belt unit.

23. The image forming apparatus according to claim 22, wherein a drum unit that includes an image carrier disposed opposite to said belt is detachably accommodated in said body casing; and said release mechanism is operated in association with an attachment and detachment of said drum unit.

24. The image forming apparatus according to claim 23, wherein:

said second abutment portion is rotatably supported at a side of said body casing against an urging force applied by said urging member;

said release mechanism rotates eccentrically in response to said operation force, and includes an operation lever allowed to press said second abutment portion; and said operation lever presses said second abutment portion when said release mechanism is in a released state, and a pressing force contains a component of a restoring force of said urging member against a rotating component of said second abutment portion.

25. An image forming apparatus comprising:

a main body provided with a cover member that is opened and closed to cover an opening formed in a side portion;

a belt unit including an endless belt, a plurality of support rollers including at least first and second support rollers for supporting said belt, and a frame portion that retains said support rollers, which is detachably installed in said main body through said opening;

a reference protrusion including a constant positional relationship with said first support roller, provided to said belt unit;

a locate member provided in said main body and including a first wall portion that supports said reference protrusion from one side, and an abutment portion provided at a side different from that of said first wall portion, which is structured such that an angle formed by a wall surface of said first wall portion and a wall surface of said abutment portion is smaller than 90°; and an urging member provided in said main body and applying a force such that said reference protrusion and said second support roller move away from each other and said reference protrusion is interposed between said first wall portion and said abutment portion.

26. An image forming apparatus comprising:

a main body provided with a cover member that is opened and closed to cover an opening formed in a side portion;

a belt unit including a belt, a plurality of support rollers including at least first and second support rollers for supporting said belt, and a frame portion that retains said support rollers, which is detachably installed in said main body through said opening, wherein:

said belt unit is further provided with a first bearing member that bears said first support roller and includes a first reference protrusion, and a second bearing member moveably attached to said frame relative to said first bearing member and includes a second reference protrusion;

said main body is further provided with a first locate member including a first wall portion on which said first reference protrusion is positioned, and a first abutment portion that abuts against said first reference protrusion on a plane opposite to said second reference protrusion;

a second locate member including a second wall portion on which said second reference protrusion is positioned, and a second abutment portion that abuts against said second reference protrusion on a plane opposite to said first reference protrusion;

an urging member that moves said second abutment portion of said second locate member so as to apply a tensile force to said belt; and a release mechanism that is brought into a released state in which said second abutment portion is moved against an urging force applied by said urging member in response to an operation force.

27. The image forming apparatus according to claim 26, wherein said first locate member is structured such that an angle formed by a wall surface of said first wall portion and a wall surface of said first abutment portion is smaller than 90°.

* * * * *